US005521490A

United States Patent [19]

Manohar

[11] Patent Number: 5,521,490

[45] Date of Patent: May 28, 1996

[54] CURRENT MIRROR WITH IMPROVED INPUT VOLTAGE HEADROOM

[75] Inventor: Amar S. Manohar, San Jose, Calif.

[73] Assignee: National Semiconductor Corporation

[21] Appl. No.: 367,433

[22] Filed: Dec. 30, 1994

Related U.S. Application Data

[63] Continuation-in-part of Ser. No. 287,117, Aug. 8, 1994, abandoned.

[51] Int. Cl.[6] ..... G05F 3/20

[52] U.S. Cl. ..... 323/315; 323/316

[58] Field of Search ..... 323/313, 314, 323/315, 316, 317

[56] References Cited

U.S. PATENT DOCUMENTS

| | | | |
|---|---|---|---|
| 3,544,882 | 8/1968 | Tanaka | 323/315 |
| 4,008,441 | 2/1977 | Schade, Jr. | 330/35 |
| 4,390,829 | 6/1983 | Jarrett | 323/231 |
| 4,473,794 | 9/1984 | Early et al. | 323/315 |
| 4,525,682 | 6/1985 | Lai et al. | 330/288 |
| 4,689,607 | 8/1987 | Robinson | 323/315 |
| 4,786,856 | 11/1988 | Metcalf et al. | 323/315 |
| 4,808,847 | 2/1989 | Van Kessel | 307/297 |
| 4,937,515 | 6/1990 | Yoshino | 323/315 |
| 5,394,079 | 2/1995 | Llewellyn | 323/315 |
| 5,402,061 | 3/1995 | Marsh et al. | 323/315 |

OTHER PUBLICATIONS

O. Schade, Jr., "Advances in BIMOS Integrated Circuits," RCA Review, vol. 39, Jun. 1978, pp. 250, 254–261, 270–271.

*Primary Examiner*—Peter S. Wong
*Assistant Examiner*—Shawn Riley
*Attorney, Agent, or Firm*—Limbach & Limbach; Alan S. Hodes

[57] ABSTRACT

A current mirror includes a first power supply terminal for receiving a first supply voltage and a second power supply terminal for receiving a second supply voltage. A first mirror transistor has a first current handling terminal, coupled to the first power supply terminals, a second current handling terminal serving as an input terminal for receiving an input current to be mirrored, and a control terminal. A second mirror transistor has a first current handling terminal coupled to the first power supply terminal, a second current handling terminal serving as an output terminal for providing a mirrored output current to a load as a function of the input current to be mirrored, and a control terminal coupled to the control terminal of the first mirror transistor. In a first embodiment, a level shift transistor has a first current handling terminal coupled to the first power supply terminal, a second current handling terminal, and a control terminal coupled to the input terminal. The level shift transistor increases the amount of input voltage headroom which would otherwise be available to operate a current source which provides the input current to be mirrored. In further embodiments, a first biasing resistance element is coupled between the first power supply terminal and the first mirror transistor control terminal, and a second biasing resistance element is couples the commonly coupled control terminals of the first and second mirror transistors to the second current handling terminal of the level shift transistor. The first and second biasing resistance elements ensure that input voltage headroom, while increased, remains low enough to keep the first current mirror transistor operating in a saturation region.

29 Claims, 14 Drawing Sheets

CURRENT MIRROR WITH IMPROVED INPUT VOLTAGE HEADROOM

RELATED APPLICATIONS

This application is a continuation-in-part of application Ser. No. 287,117, filed Aug. 8, 1994 now abandoned.

TECHNICAL FIELD OF THE INVENTION

The present invention relates to current mirrors suitable for use at low power supply voltages, and in particular, to current mirrors that increase the amount of input voltage headroom.

BACKGROUND OF THE INVENTION

Current mirrors are well known in the art. For example, a conventional P-channel enhancement-mode MOSFET ("PMOS") current mirror 100 is schematically illustrated in FIG. 1. Conventional current mirror 100 includes a $V_{cc}$ supply voltage terminal 104 and a negative supply voltage terminal 106. $V_{cc}$ is typically 5 volts and the negative supply voltage is typically 0 volts (i.e. ground).

A first PMOS transistor P1 serves as an input device, having its source connected to $V_{cc}$ terminal 104 and its drain connected to receive input current $I_{IN}$ from a current source 102. In practice, current source 102 is likely to be fabricated of additional circuitry contained on the same integrated circuit as current mirror 100. The gate to source voltage of PMOS transistor P1 (abbreviated for clarity as "$V_{GS(P1)}$") varies with the value of the current $I_{IN}$ forced to flow from the drain of PMOS transistor P1 (i.e. the drain current).

A second PMOS transistor P2 serves as an output device, having its source connected to $V_{cc}$ terminal 104 and its drain connected to a load L. Since the gate of PMOS transistor P2 is connected to the gate of PMOS transistor P1, the gate to source voltage of PMOS transistor P2 ("$V_{GS(P2)}$") equals $V_{GS(P1)}$. As a result, if both PMOS transistor P1 and PMOS transistor P2 are operating in the saturation region, the input current $I_{IN}$ is mirrored through the drain of PMOS transistor P2 as an output current $I_{OUT}$. If desired, the sizes of PMOS transistor P1 and PMOS transistor P2 can be ratioed so that $I_{OUT}$ can be any desired fraction less than or greater than $I_{IN}$.

The requirement for PMOS transistor P1 and PMOS transistor P2 operating in the saturation region is now discussed. In general, the relationship between the drain current ("$I_D$") and the $V_{DS}$ of a PMOS transistor defines a family of curves, where each curve exhibits the relationship for a particular $V_{GS}-V_T$, $V_T$ being the threshold voltage for the PMOS transistor (i.e. the gate to source voltage at which drain current begins to flow). An example of such a family of curves is shown in FIG. 2. For "small" $V_{DS}$'s, the PMOS transistor operates in the linear region, where $I_D$ is approximately proportional to $V_{DS}$. For "large" $V_{DS}$'s, the PMOS transistor operates in the saturation region, where $I_D$ is approximately constant, regardless of $V_{DS}$. The $V_{DS}$ where the transition is made from the linear region to the saturation region is known as $V_{DSAT}$.

Referring again to FIG. 1, it can be seen that the voltage across current source 102 ("V1") varies with the current $I_{IN}$ drawn by current source 102, since the voltage between $V_{CC}$ terminal 104 and negative terminal 106 is fixed and $V_{DS(P1)}$ varies with the current $I_{IN}$ produced by current source 102. Furthermore, due to the non-negligible impedance of load L, the voltage across load L, and thus $V_{DS(P2)}$, varies with the current $I_{OUT}$ from the drain of PMOS transistor P2. But, if both PMOS transistor P1 and PMOS transistor P2 are operated in the saturation region, where $I_D$ depends substantially only on $V_{GS}-V_T$, and not on $V_{DS}$, since $V_{GS(P2)}$ is guaranteed to equal $V_{GS(P1)}$, $I_{OUT}$ is guaranteed to be related to $I_{IN}$ only by the ratio of the sizes of PMOS transistor P1 and PMOS transistor P2.

As will now be discussed, due to the configuration in which PMOS transistor P1 is connected in the conventional current mirror circuit 100, PMOS transistor P1 is guaranteed to be always operating in the saturation region. Generally, for a PMOS transistor to be operating in the saturation region, the following condition must be satisfied:

$$V_{DS} \geq V_{GS}-V_T \qquad \text{saturation region (1a)}$$

Conversely, for a PMOS transistor to be operating in the linear region, the following condition must be satisfied:

$$V_{DS} < V_{GS}-V_T \qquad \text{linear region (1b)}$$

In the current mirror 100, since the drain and gate of PMOS transistor P1 are connected, $V_{DS(P1)}$ is guaranteed to be always equal to $V_{GS(P1)}$, and thus the condition in 1(a) is always true for PMOS transistor P1. As a result, PMOS transistor P1 is guaranteed to be always operating in the saturation region.

Furthermore, if the voltage across load L ("$V_{LOAD}$") is kept sufficiently small, then $V_{DS(P2)}$ (i.e. $V_{CC}-V_{LOAD}$) remains large enough to keep PMOS transistor P2 in the saturation region. $V_{LOAD}$ is kept small by limiting the impedance of load L ($Z_{OUT}$) and/or by limiting the current $I_{IN}$ being mirrored as $I_{OUT}$ (remember, $V_{LOAD}=I_{OUT}*Z_{OUT}$). The voltage V1 on the drain of PMOS transistor P1, which is connected to current source 102, is governed by the following relationship:

$$V1=V_{CC}-(V_{T(P1)}+V_{DSAT(P1)}) \qquad (2)$$

$V_{T(P1)}$ is typically 1 volt, and $V_{DSAT(P1)}$ is typically 0.2 to 0.8 volts. Thus, $V_{T(P1)}+V_{DSAT(P1)}$ is typically between approximately 1.2 and 1.8 volts, depending on the current flow through PMOS transistor P1, the size of PMOS transistor P1, and the operating temperature of the circuit.

In a typical prior art system wherein $V_{CC}$ is approximately 5 volts, V1 is within the range of approximately 3.2 to 3.8 volts, which is sufficiently high to allow easy design and fabrication of circuitry within the integrated circuit to serve as input current source 102 and to accommodate various loads L. However, there is an increasing desire to provide integrated circuits capable of operating at lower voltages, for example where $V_{CC}$ equals 3 volts. In the case, V1 would range from approximately 1.2 volts to 1.8 volts. Given the fact that, in a nominal 3 volt supply, a 10% deviation is acceptable, meaning a legitimate $V_{CC}$ might be as low as 2.7 bolts, V1 would range from approximately 0.9 to 1.5 volts. This low voltage available as voltage V1 in a conventional current mirror 100 operating at a low $V_{CC}$ voltage of 2.7 to 3.0 volts is in many circumstances insufficient to allow design and/or proper operation of circuitry serving as current source 102.

FIG. 3 is a schematic illustration of a prior art current mirror 300 that provides improved input voltage headroom. Like the FIG. 1 conventional current mirror 100, current mirror 300 includes $V_{CC}$ supply voltage terminal 104 and negative supply voltage terminal 106 which is typically connected to ground. Input current $I_{IN}$ is applied by current source 102 to the drain of PMOS transistor P1, which has its source connected to $V_{CC}$ terminal 104. The gates of PMOS transistor P1 and P2 are connected in common and the source of PMOS transistor P2 is also connected to $V_{CC}$ terminal 104. The drain of PMOS transistor P2 is connected to provide output current $I_{OUT}$ to load L.

As further shown in FIG. 3, N-channel enhancement-mode MOSFET ("NMOS") transistor N11 is a level shift transistor used to provide an increased "headroom" voltage to current source 102. NMOS level shift transistor N11 has its drain connected to $V_{CC}$ supply terminal 104, its source connected to the commonly connected gates of PMOS transistors P1 and P2, and its gate connected to the drain of PMOS transistor P1 and thus to input current source 102. A bias current source 304 draws bias current $I_{BIAS}$ through NMOS level shift transistor N11 to ground. Current mirror 300 provides a headroom voltage V1 to current source 102:

$$V1=V_{CC}-(V_{T(P1)}+V_{DSAT(P1)})+V_{GS(N11)} \quad (3)$$

A further prior art current mirror 400 is shown schematically in FIG. 4. Like the FIG. 3 current mirror 300, current mirror 400 includes $V_{CC}$ supply voltage terminal 104 and negative supply voltage terminal 106 which is typically connected to ground. Input current $I_{IN}$ is applied by current source 102 to the drain of PMOS transistor P1, which has its source connected to $V_{CC}$ terminal 104. The gates of PMOS transistors P1 and P2 are connected in common and the source of PMOS transistor P2 is connected $V_{CC}$ terminal 104. The drain of PMOS transistor P2 is connected to provide output current $I_{OUT}$ to load L.

NPN transistor N11' is a bipolar level shift transistor used to provide an increased voltage to current source 102. NPN level shift transistor N11' has its collector connected to $V_{CC}$ supply terminal 104, its emitter connected to the commonly connected gates of PMOS transistors P1 and P2, and its base connected to the drain of PMOS transistor P1 and thus to input current source 102. A bias current source 304 draws bias current $I_{BIAS}$ through NPN level shift transistor N11' to ground.

Current mirror 400 provides a voltage V1 to current source 102:

$$V1=V_{CC}-(V_{T(P1)}+V_{DSAT(P1)})+V_{be(N11')}. \quad (4)$$

The base to emitter voltage of NPN level shift transistor N11' ($V_{be(N11')}$ must be kept less than $V_{T(P1)}$ in order to keep PMOS transistor P1 operating in the saturation region. If $V_{be(N11')}$ is greater than $V_{T(P1)}$, PMOS transistor P1 will cease to be saturated and will operate in the linear region, and therefore will not act as current source.

FIG. 5 is a schematic illustration of a yet further prior art current mirror 500. Current mirror 500 includes $V_{CC}$ supply voltage terminal 154 and negative supply voltage terminal 156 which is typically connected to ground. Input current $I_{IN}$ is applied by a current source 152 to the drain of NMOS transistor N1, which has its source connected to negative supply voltage terminal 156. The gates of NMOS transistors N1 and N2 are connected in common and the source of MOS transistor N2 is connected to negative supply voltage terminal 156. The drain of NMOS transistor N2 is connected to provide output current $I_{OUT}$ to load L.

PMOS transistor P11 is a MOS level shift transistor used to provide an increased voltage to current source 152. PMOS level shift transistor P11 has its drain connected to negative voltage supply terminal 156, its source connected to the commonly connected gates of NMOS transistors N1 and N2, and its gate connected to the drain of NMOS transistor N1 and thus to input current source 152. A bias current source 354 draws bias current $I_{BIAS}$ through PMOS level shift transistor P11 from $V_{CC}$ voltage supply terminal 154. Current mirror 500 provides a voltage V51 to current source 152:

$$V51=(V_{TN1}+V_{DSAT(N1)})-V_{GS(P11)} \quad (5)$$

A yet further prior art current mirror 600 is shown schematically in FIG. 6. Current mirror 600 includes $V_{CC}$ supply voltage terminal 154 and negative supply voltage terminal 156 which is typically connected to ground. Input current $I_{IN}$ is applied by current source 152 to the drain of NMOS transistor N1, which has its source connected to negative voltage supply terminal 156. The gates of NMOS transistors N1 and N2 are connected in common and the source of NMOS transistor N2 is connected to negative voltage supply terminal 156. The drain of NMOS transistor N2 is connected to provide output current $I_{OUT}$ to load L.

PNP transistor P11' is a bipolar level shift transistor used to provide an increased voltage to current source 152. PNP level shift transistor P11' has its collector connected to negative voltage supply terminal 156, its emitter connected to the commonly connected gates of NMOS transistors N1 and N2, and its base connected to the drain of NMOS transistor N1 and thus to input current source 152. A bias current source 354 sources bias current $I_{BIAS}$ through PNP level shift transistor P11' from $V_{CC}$.

Current mirror 600 provides a voltage V51 to current source 152:

$$V51=(V_{T(N1)}+V_{DSAT(N1)})-V_{be(P11')}. \quad (6)$$

The base to emitter voltage of PNP level shift transistor P11' ($V_{be(P11')}$ must be kept less than $V_{T(N1)}$ in order to keep NMOS transistor N1 operating in the saturation region. If $V_{be(P11')}$ is greater than $V_{T(N1)}$, NMOS transistor N1 will cease to be saturated and will operate in the linear region, and therefore will not act as current source.

A drawback of the current mirrors 300 and 500 is that process variations must be considered in designing for reliable operation. That is, for current mirror 300, if $V_{T(P1)}$ is low (i.e. fast PMOS) and $V_{T(N11)}$ (and, therefore, $V_{GS(N11)}$) is high (i.e. slow NMOS), current mirror 300 may operate in the linear region rather than the saturation region. Also, operating conditions must be considered since $V_T$ for PMOS devices and $V_T$ for NMOS devices may vary differently with varying temperature. For example, for current mirror 500, if $V_{T(N1)}$ is low (i.e. fast NMOS) and $V_{T(P11)}$ (and, therefore, $V_{GS(P11)}$) is high (i.e. slow PMOS), current mirror 500 may operate in the linear region rather than the saturation region.

Similarly, for current mirror 400, if $V_{be(N11')}$ becomes greater than $V_{T(P1)}$, PMOS transistor P1 will cease to be saturated and will operate in the linear region; and for current mirror 600, if $V_{be(P11')}$ becomes greater than $V_{T(N1)}$, NMOS transistor N1 will cease to be saturated and will operate in the linear region. However, since $V_{T(P1)}$ *and* $Vbe(N11')$ (and $V_{T(N1)}$ and $V_{be(P11')}$) tend to track nicely over temperature, current mirrors 400 and 600 address the problem of current mirrors 300 and 500 of $V_{T(P1)}$ and $V_{T(N1)}$ varying differently with temperature. However, bipolar level shift transistors N11' and P11', respectively, of current mirrors 400 and 600 have a base current error not present in the MOS level shift transistors N11 and P11, respectively, of current mirrors 300 and 500. That is, the bipolar level shift transistor N11' and P11' have a base current such that some of the current $I_{IN}$ is drawn through the base of the bipolar level shift transistors and therefore not mirrored, causing an error in $I_{OUT}$. Futhermore, one of the largest drawbacks of current mirrors 400 and 600 is that emerging process technologies are making it possible to have lower $V_T$'s, and the such low $V_t$'s, PMOS transistor P1 of current mirror 400 and NMOS transistor N1 of current mirror 600 still use excess headroom voltage that could be provided to input current source 152 and to load L.

SUMMARY OF THE INVENTION

A current mirror in accordance with the present invention includes a first power supply terminal for receiving a first supply voltage and a second power supply terminal for receiving a second supply voltage. A first mirror transistor has a first current handling terminal, coupled to a first one of the power supply terminals, and a second current handling terminal serving as an input terminal for receiving an input current to be mirrored. The first mirror transistor further has a control terminal. A second mirror transistor has a first current handling terminal coupled to the first power supply terminal, a second current handling terminal serving as an output terminal for providing a mirrored output current to a load as a function of the input current to be mirrored, and a control terminal coupled to the control terminal of the first mirror transistor.

A level shift device, which is a level shift transistor, has a first current handling terminal coupled to the first power supply terminal, a second current handling terminal, and a control terminal coupled to the input terminal. The level shift device increases the amount of input voltage headroom which would otherwise be available to operate a current source which provides the input current to be mirrored.

Furthermore, a first biasing resistance element is coupled between the first power supply terminal and the first mirror transistor control terminal, and a second biasing resistance element couples the commonly coupled control terminals of the first and second mirror transistors to the second current handling terminal of the level shift device. The first and second biasing resistance elements ensure that input voltage headroom, while increased, remains low enough to keep the first current mirror transistor operating in a saturation region.

A better understanding of the features and advantages of the invention will be obtained by reference to the following detailed description and accompanying drawings which set forth an illustrative embodiment in which the principles of the invention are utilized.

DETAILED DESCRIPTION OF THE INVENTION

Figure 1:
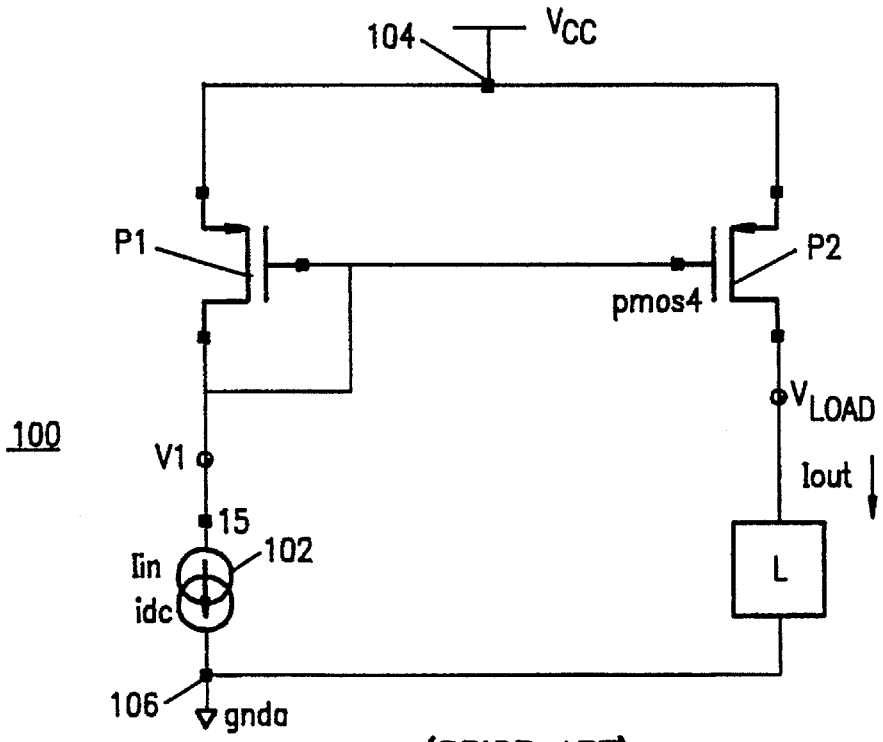
(PRIOR ART) FIG. 1
FIG. 1 is a schematic illustration of a conventional PMOS current mirror.
Figure 2:
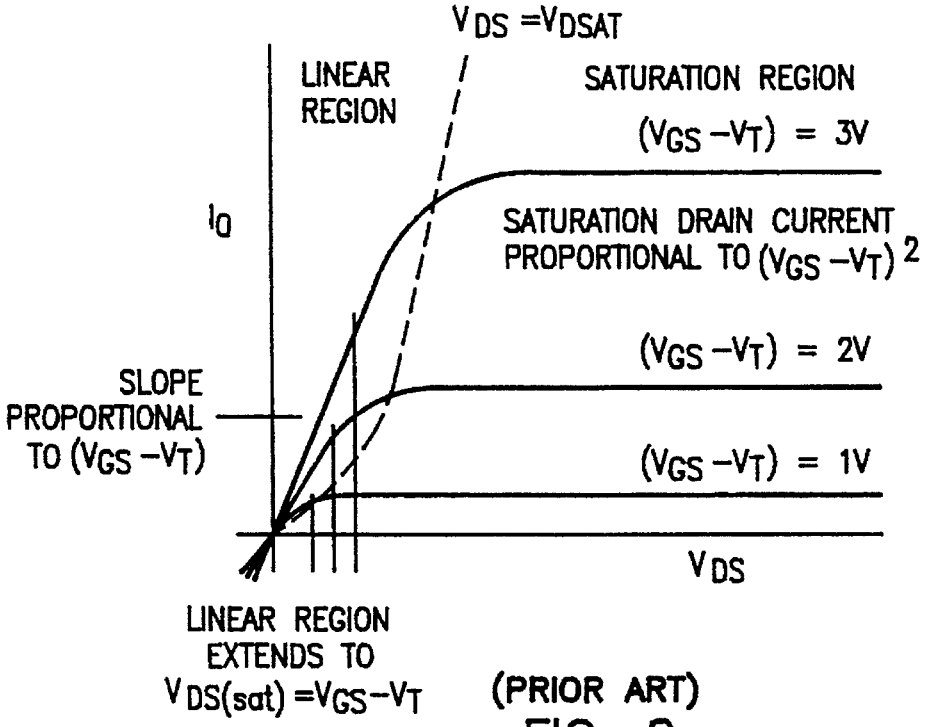
(PRIOR ART) FIG. 2
FIG. 2 is a graph which illustrates the linear and saturation operating regions of a MOS transistor.
Figure 3:
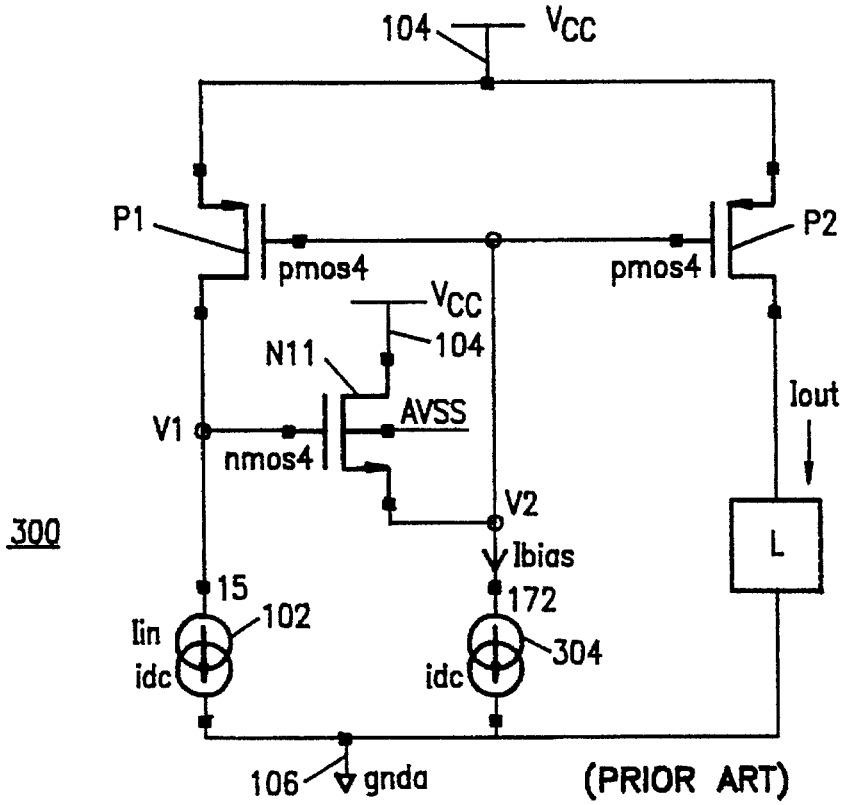
(PRIOR ART) FIG. 3
FIG. 3 is a schematic illustration of a prior art PMOS current mirror which utilizes an NMOS transistor for level shifting.
Figure 4:
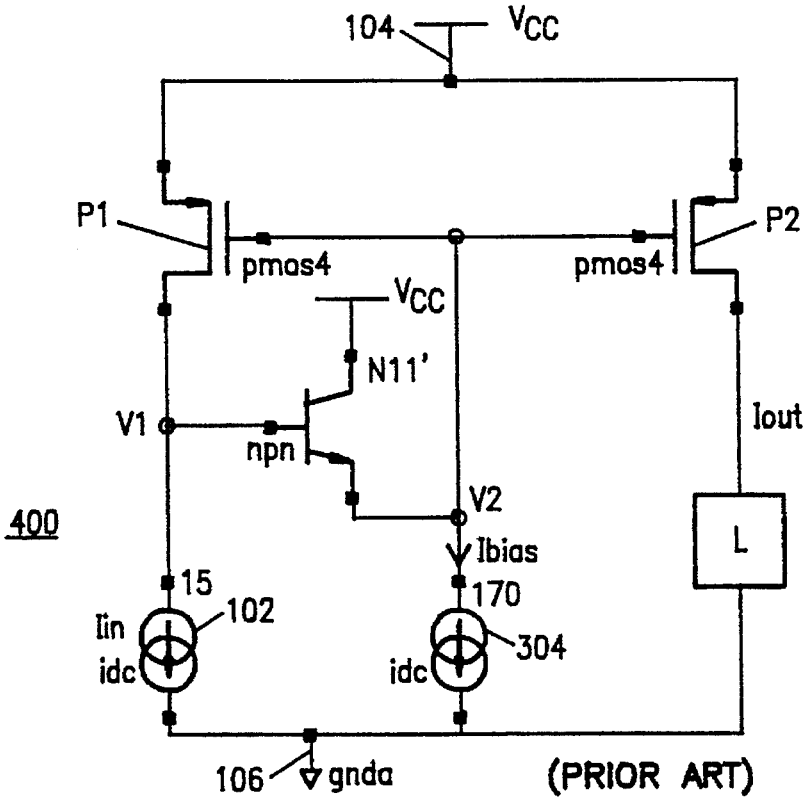
(PRIOR ART) FIG. 4
FIG. 4 is a schematic illustration of a prior art PMOS current mirror which utilizes an NPN transistor for level shifting.
Figure 5:
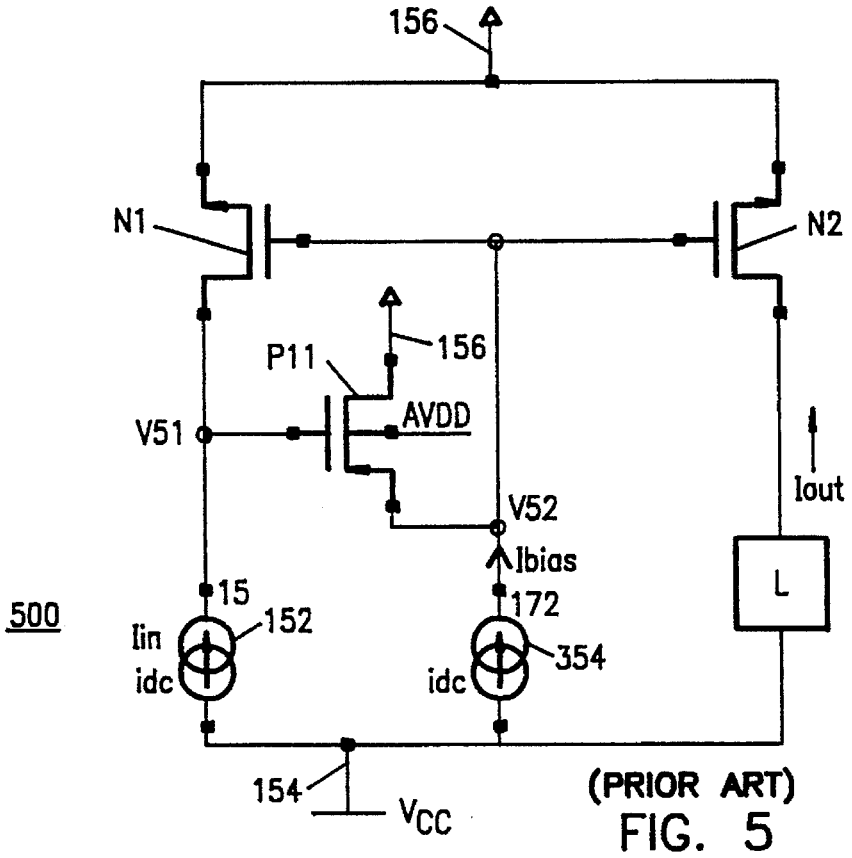
(PRIOR ART) FIG. 5
FIG. 5 is a schematic illustration of a prior art NMOS current mirror which utilizes a PMOS transistor for level shifting.
Figure 6:
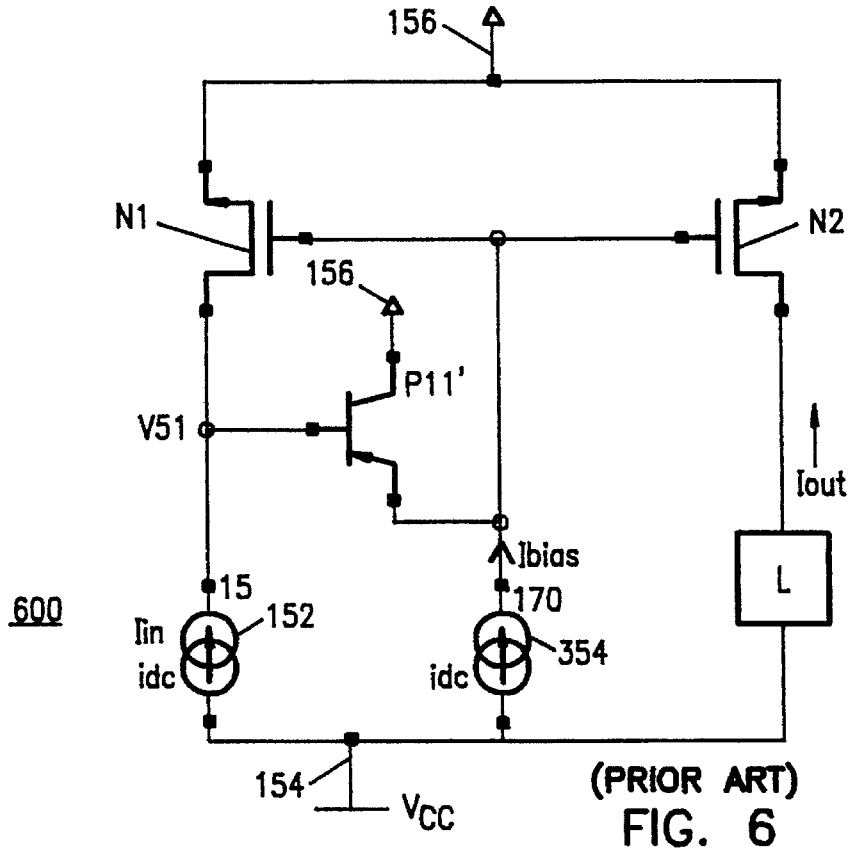
(PRIOR ART) FIG. 6
FIG. 6 is a schematic illustration of a prior art NMOS current mirror which utilizes a PNP transistor for level shifting.
Figure 7:
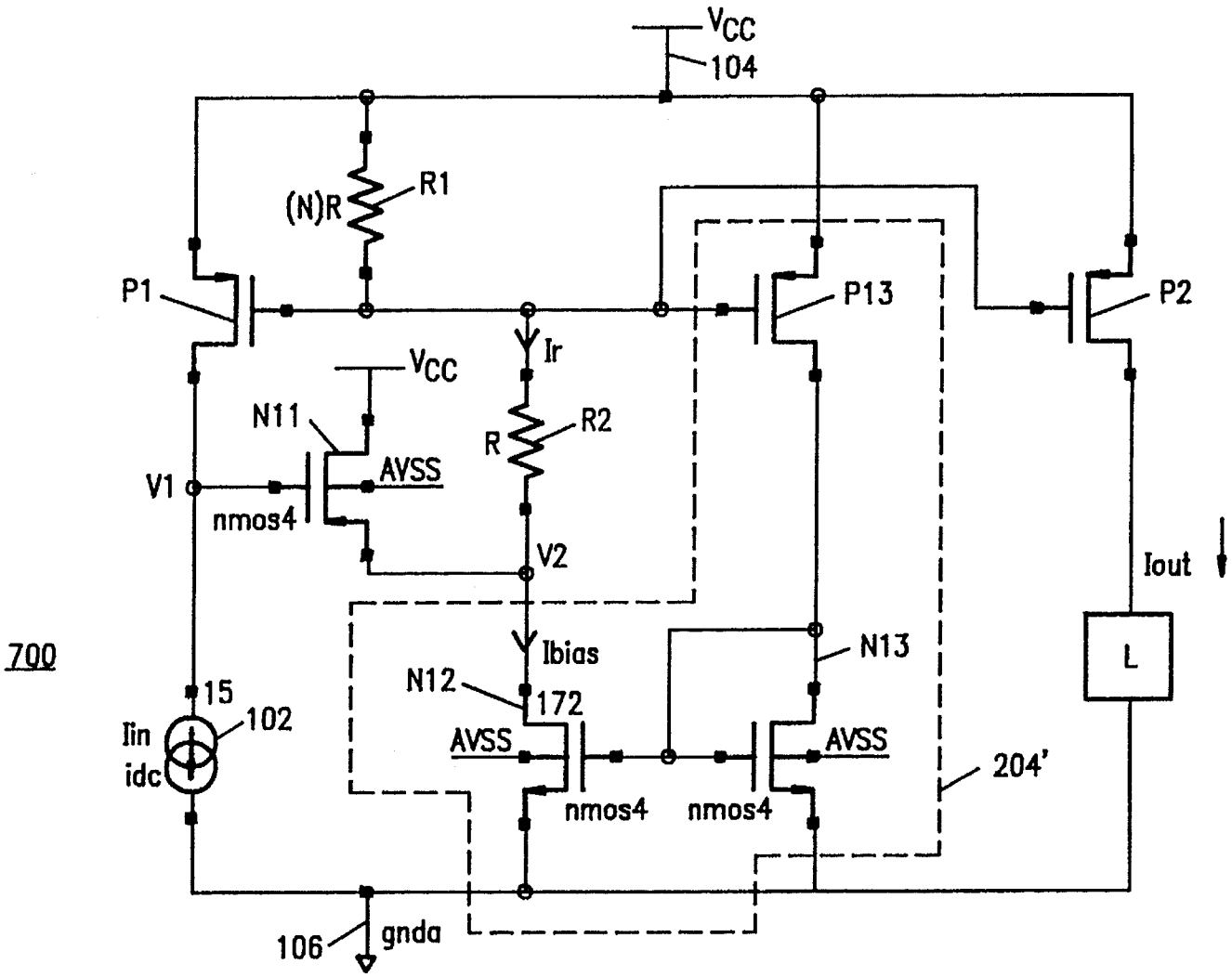
FIG. 7 is a schematic illustration of a PMOS current mirror in accordance with the present invention which utilizes an NMOS level shift transistor for level shifting and a built-in bias current source for biasing the NMOS level shift transistor, and which further utilizes ratioed resistors to keep a first transistor of the PMOS current mirror operating in a saturation region.

FIG. 7 is a schematic diagram of a current mirror 700 in accordance with the invention. As is discussed in greater detail below, the invention employs ratioed resistors to ensure that input headroom, while increased, remains lower than the difference between $V_{CC}$ and $V_{DSAT}$ over worst case process and temperature variations. Current mirror 700 includes a $V_{cc}$ supply voltage terminal 104 and a negative supply voltage terminal 106. A first PMOS transistor P1 serves as an input device, having its source connected to $V_{cc}$ terminal 104 and its drain connected to receive input current $I_{IN}$ from a current source 102. A second PMOS transistor P2 serves as an output device, having its source connected to $V_{cc}$ terminal 104 and its drain connected to a load L.

NMOS transistor N11 is a MOS level shift transistor used to provide an increased headroom voltage to current source 102. NMOS level shift transistor N11 has its drain connected to $V_{CC}$ supply terminal 104 and its gate connected to the drain of PMOS transistor P1 and thus to input current source 102. A network of bias current source transistors including bias current source PMOS transistor P13, bias current source NMOS transistor N13, and bias current source NMOS transistor N12 provide a "built-in" bias current source 204' which draws a portion of a bias current $I_{BIAS}$ through the drain of bias current source NMOS transistor N12, which is connected to the source of NMOS level shift transistor N11.

The operation of "built-in" bias current source 204' is now discussed. Bias current source PMOS transistor P13 has its source connected to $V_{CC}$ supply voltage terminal 104 and its gate connected to the gate of PMOS transistor P1. Thus, current $I_{IN}$ from current source 102 is mirrored to the drain of bias current source PMOS transistor P13. Bias current source NMOS transistor N13 has its source connected to negative supply voltage terminal 106 and its drain connected to its gate. Bias current source NMOS transistor N13 further has its drain connected to the drain of bias current source PMOS transistor P13 to receive the mirrored current. Bias current source NMOS transistor N12 has its gate connected to the gate of bias current source NMOS transistor N13 and its source connected to negative supply voltage terminal 106. Thus, the mirrored current from the drain of bias current source PMOS transistor P13 is further mirrored through the drain of bias current source NMOS transistor N12.

As is discussed in detail below, first and second biasing resistors R1 and R2, respectively, ensure that the voltage at the gate of NMOS level shift transistor N11 ("V1") is lower than the difference between $V_{CC}$ and $V_{DSAT(P1)}$ over worst case process and temperature variations. First biasing resistor R1 is connected between the $V_{CC}$ terminal 104 and the gate of first PMOS transistor P1, and second biasing resistor R2 is connected between the gate of first PMOS transistor P1 and the commonly connected source of NMOS level shift transistor N11 and the drain of bias current source NMOS transistor N12.

Second biasing resistor R2 has a resistance value of R and first biasing resistor R1 has a resistance value of N*R, N being a natural number. The process for choosing the relative resistance values (i.e. "N") of first and second resistors R1 and R2 is now discussed. The voltage across first biasing resistor R1 is $V_{GS(P1)}$. A current $I_r$ is developed across first biasing resistor R1 responsive to $V_{GS(P1)}$; $I_r$ is $V_{GS(P1)}/(N*R)$. Since the gates of PMOS transistors P1 and P2 cannot source or sink current, the current across second biasing resistor R2 is also $I_r$; the voltage across second biasing resistor R2 is $I_r*R$. Thus, V2 is $$V2 = V_{CC} - \left(\frac{N+1}{N}\right) V_{GS(P1)} \geqq V_{DSAT(N12)} \tag{7}$$

and the input headroom voltage V1 is $$V1 = V2 + V_{GS(N11)} \leqq V_{CC} - V_{DSAT(P1)} \tag{8}$$

As discussed above, $V_{GS(P1)}$ varies with processing and temperature. The maximum value of V2 ("V2max"), assuming the absolute value of $V_{GS(P1)}$ is at its minimum value ("$|V_{GS(P1)}|$fast") is given by:

$$V2\max = V_{CC} - \left(\frac{N+1}{N}\right) |V_{GS(P1)}|\text{fast} \tag{9}$$

The minimum value of V2 ("V2min"), assuming the absolute value of $V_{GS(P1)}$ is at its maximum value ("$|V_{GS(P1)}|$slow") is given by:

$$V2\min = V_{CC} - \left(\frac{N+1}{N}\right) |V_{GS(P1)}|\text{slow} \tag{10}$$

$V_{GS(N11)}$ also varies with processing and temperature. The maximum value of V1 ("V1max"), assuming the absolute value of $V_{GS(N11)}$ is at its maximum value ("$|V_{GS(N11)}|$slow") is given by:

$$V1\max = (V2\max + |V_{GS(N11)}|\text{slow}) \leqq V_{CC} - V_{DSAT(P1)}(\text{desired}) \tag{11}$$

The minimum value of V1 ("V1min"), assuming the absolute value of $V_{GS(N11)}$ is at its minimum ("$|V_{GS(N11)}|$fast") is given by:

$$V1\min = (V2\min + |V_{GS(N11)}|\text{fast}) \geqq V1\min\ (\text{desired}) \tag{12}$$

Furthermore, $$|V_{GS(N11)}|\text{fast} = |V_{T(N11)}|\text{fast} + \Delta Vt + V_{DSAT(N11)} \tag{13}$$

and $$|V_{GS(N11)}|\text{slow} = |V_{T(N11)}|\text{slow} + \Delta Vt + V_{DSAT(N11)} \tag{b 14}$$

where $$\Delta Vt = \gamma\left[\sqrt{2|\phi f| + Vsb} - \sqrt{2|\phi f|}\right] \tag{15}$$

which accounts for the body effect (i.e. the increased threshold voltage due to the NMOS devices sitting in a P substrate and the PMOS devices sitting in an N substrate). If twin well processes are used (i.e the P wells are isolated from the substrate and each other), then the body effect term $\Delta V_t$ is zero.

Substituting the V2 max/min relationship ((9) and (10)) into the V1 max/min relationship ((11) and (12)) yields an equation (16) for which only the upper bound of N("$N_{upper}$") is unknown:

$$V_{DSAT(P1)}(\text{desired}) \leqq \left[\left(\frac{N_{upper}+1}{N_{upper}}\right)(|V_{T(P1)}|\text{fast} + V_{DSAT(P1)})\right] - (|V_{GS(N11)}|\text{slow} \tag{16}$$

and an equation (17) for which only the lower bound of N("$N_{lower}$") is unknown:

$$V2\text{min} = V_{CC} - \left(\frac{N_{lower}+1}{N_{lower}}\right)(|V_{T(P1)}|\text{slow} + V_{DSAT(P1)}) + |V_{GS(N11)}|\text{fast} \tag{17}$$

From (16), $N_{upper}$ can be calculated. That is, $N_{upper}$ is $$N_{upper} = \frac{V_{DSAT(P1)} + |V_{T(P1)}|\text{fast}}{|V_{GS(N11)}|\text{slow} - |V_{T(P1)}|\text{fast}} \tag{18}$$

From (17), $N_{lower}$ can be calculated.

$$N_{lower} = \frac{|V_{T(P1)}|\text{slow} + V_{DSAT(P1)}}{V_{CC} - (V2\text{min} - |V_{GS(N11)}|\text{fast} + |V_{T(P1)}|\text{slow} + V_{DSAT(P1)})} \tag{19}$$

In practice, a value of N between $N_{upper}$ and $N_{lower}$ would be chosen ("$N_{chosen}$"), and the chosen value for N would be fine tuned with simulations.

Furthermore, NMOS level shift transistor N11 may be sized to so as to make $V_{DSAT(N11)}$ negligible to provide further assurance that PMOS current mirror transistor P1 remains saturated.

Based on $N_{chosen}$, the resistor value "R" can be calculated. "R" is a value such that the worst case expected variation in the absolute values of the resistor values, as well as variations in $V_{GS(P1)}$ due to process variations, does not de-bias NMOS level shift transistor N11. In a preferred embodiment, the resistor value "R" is such that current flow through first and second bias resistor R1 and R2 is ½ to ⅔ of $I_{BIAS}$. In this way, there will always be a portion of $I_{BIAS}$ available to pull current from the drain of NMOS level shift transistor N11. That is, if $I_r$ is chosen to be ⅔ of $I_{BIAS}$, and assuming $I_{BIAS}=I_{IN}$:

$$I_r = I_{BIAS} * .66 = I_{IN} * .66 = \frac{V_{GS(P1)}}{N_{chosen} * R} \tag{20}$$

$$R = \frac{V_{GS(P1)}}{N_{chosen} * .66 * I_{IN}} \tag{21}$$

Figure 8:
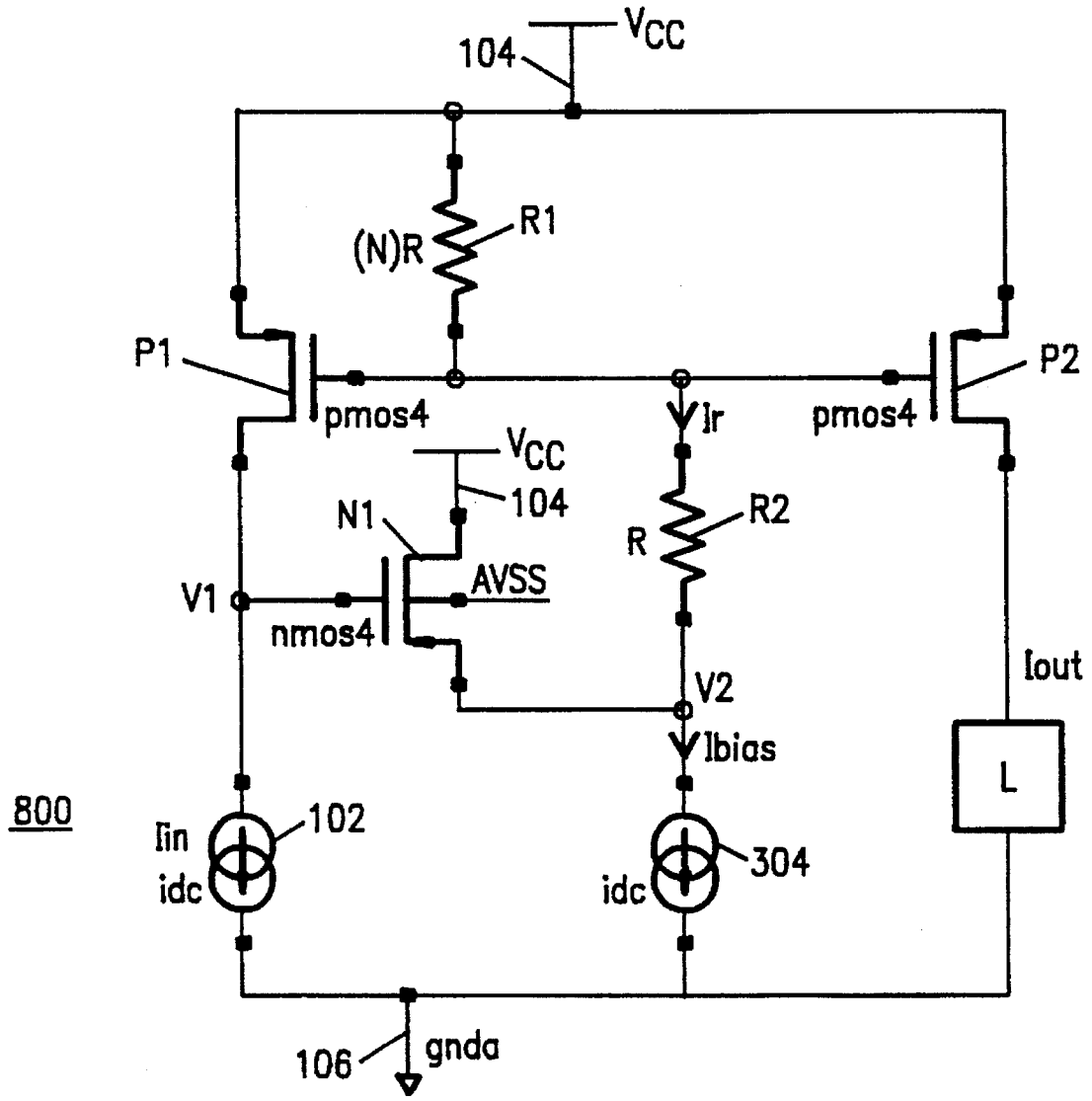
FIG. 8 is a schematic illustration of a PMOS current mirror in accordance with the present invention which utilizes an NMOS level shift transistor for level shifting and an independent bias current source for biasing the NMOS level shift transistor, and which further utilizes ratioed resistors to keep a first transistor of the PMOS current mirror operating in a saturation region.

FIG. 8 is a schematic diagram of a current mirror 800 in accordance with a further embodiment of the invention. Current mirror 800 is identical to current mirror 700, except that the built-in" bias source 204' of current mirror 700 is replaced by an independent bias current source 304. Thus, the operation of current mirror 800 is similar to the operation of the current mirror 700, except that the constraint of $V2 \geqq V_{DSAT(N12)}$ of equation (7) (to keep bias current NMOS transistor N12 saturated), is removed.

Figure 9:
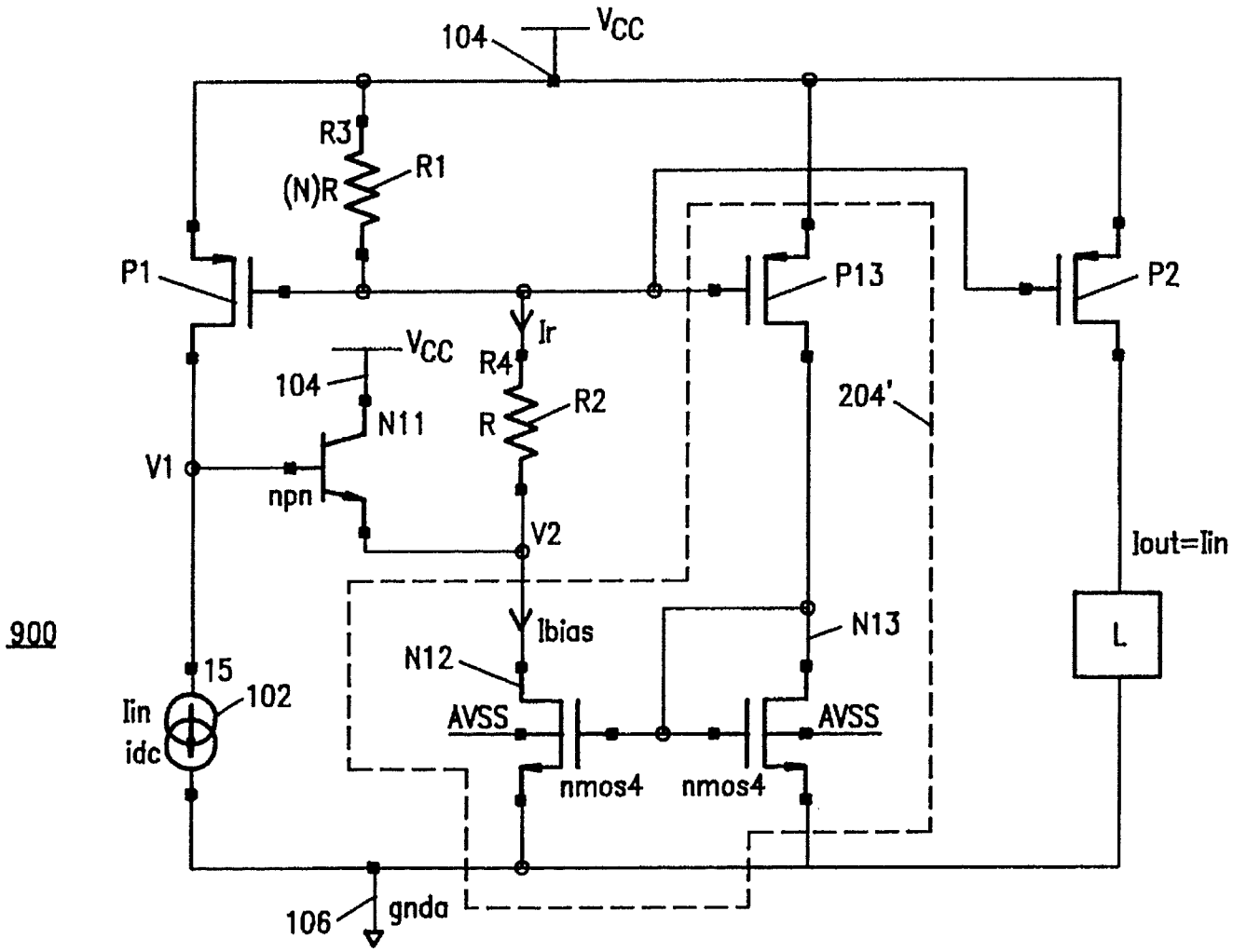
FIG. 9 is a schematic illustration of a PMOS current mirror in accordance with the present invention which utilizes an NPN level shift transistor for level shifting and built-in bias current source for biasing the NPN level shift transistor, and which further utilizes ratioed resistors to keep a first transistor of the PMOS current mirror operating in a saturation region.

FIG. 9 is a schematic diagram of a current mirror 900 in accordance with a still further embodiment of the invention. Current mirror 900 is similar to current mirror 700, except that NMOS level shift transistor N11 is replaced by NPN level shift transistor N11'. That is, NPN level shift transistor N11' has its collector connected to $V_{CC}$ supply terminal 104 and its base connected to the drain of PMOS transistor P1 and thus to input current source 102. The network of bias current source transistors provide a "built-in" bias current source 204' which draws a portion of a bias current $I_{BIAS}$ from the drain of bias current source NMOS transistor N12 and a portion of $I_{BIAS}$ from the emitter of NPN level shift transistor N11'.

In current mirror 900, first and second biasing resistors R1 and R2, respectively, ensure that the voltage at the base of NPN level shift transistor N11' ("V1") is lower than the difference between $V_{CC}$ and $V_{DSAT(P1)}$ over worst case process and temperature variations. First biasing resistor R1 is connected between the $V_{CC}$ terminal 104 and the gate of first PMOS transistor P1, and second biasing resistor R2 is connected between the gate of first PMOS transistor P1 and bias current source NMOS transistor N12.

Second biasing resistor R2 has a resistance value of R and first biasing resistor R1 has a resistance value of N*R, N being a natural number. The process for choosing the relative values (i.e. "N") of first and second resistors R1 and R2 is similar to the process for choosing the relative values of first and second resistors R1 and R2 for current mirrors 500 and 600, where $V_{be(N1')}$ is substituted for $V_{GS(N1)}$. The voltage across first biasing resistor R1 is $V_{GS(P1)}$. The current $I_r$ across first biasing resistor R1 is thus $V_{GS(P1)}/(N*R)$. Since the current across second biasing resistor R2 is also $I_r$, the voltage across second biasing resistor R2 is $I_r$*R. Thus, V2 is $$V2 = V_{CC} - \left(\frac{N+1}{N}\right) V_{GS(P1)} \geqq V_{DSAT(N12)} \tag{22}$$

and the input voltage headroom is $$V1 = V2 + V_{be(N11')} \leqq V_{CC} - V_{DSAT(P1)} \tag{23}$$

As discussed above, $V_{GS(P1)}$ varies with processing and temperature. The maximum value of V2 ("V2max"), assuming the absolute value of $V_{GS(P1)}$ is at its minimum value ("$|V_{GS(P1)}|$fast") is given by:

$$V2\text{max} = V_{CC} - \left(\frac{N+1}{N}\right)|V_{GS(P1)}|\text{fast} \tag{24}$$

The minimum value of V2 ("V2min"), assuming the absolute value of $V_{GS(P1)}$ is at its maximum value ("$|V_{GS(P1)}|$slow") is given by:

$$V2\text{min} = V_{CC} - \left(\frac{N+1}{N}\right)|V_{GS(P1)}|\text{slow} \tag{25}$$

$V_{be(N11')}$ also varies with processing and temperature. The maximum value of V1 ("V1max"), assuming the absolute value of $V_{be(N11')}$ is at its maximum value ("$|V_{be(N1')}|$high") is given by:

$$V1\text{max} = (V2\text{max} + |V_{be(N11')}|\text{high}) \leqq V_{CC} - V_{DSAT(P1)}\ (\text{desired}) \tag{26}$$

The minimum value of V1 ("V1min"), assuming the absolute value of $V_{be(N1')}$ is at its minimum ("$|V_{be(N11')}|$low") is given by:

$$V1\text{min} = (V2\text{min} + |V_{be(N11')}|\text{low}) \geqq V1\text{min}\ (\text{desired}) \tag{27}$$

Thus, $$V_{DSAT(P1)}(\text{desired}) \leqq \tag{28}$$

-continued $$\left[\left(\frac{N_{upper}+1}{N_{upper}}\right)(|V_{T(P1)}|\text{fast}+V_{DSAT(P1)})\right]-$$

$$(|V_{be(N11')}|\text{high}+\Delta V_{be(N11')})+V_{cesat(N11')}$$

and $$V1\min = V_{CC} - \tag{29}$$

$$\left(\frac{N_{lower}+1}{N_{lower}}\right)(|V_{T(P1)}|\text{slow}+V_{DSAT(N11')}+|V_{be(N11')}|\text{low}$$

From (28), $N_{upper}$ can be calculated. That is, $N_{upper}$ is:

$$N_{upper} = \tag{30}$$

$$\frac{V_{DSAT(P1)}+|V_{T(P1)}|\text{fast}}{|V_{be(N11')}|\text{high}+\Delta V_{be(N11')}-|V_{T(P1)}|\text{fast}+V_{cesat(N11')}}$$

From (29), $N_{lower}$ can be calculated. $N_{lower}$ is:

$$N_{lower} = \tag{31}$$

$$\frac{|V_{T(P1)}|\text{slow}+V_{DSAT(P1)}}{V_{CC}-(V2_{min}-|V_{be(N11')}|\text{low}+|V_{T(P1)}|\text{slow}+V_{DSAT(P1)})}$$

In practice, a value for N between $N_{upper}$ and $N_{lower}$ would be chosen, and the chosen value for N ("$N_{chosen}$") would be fine-tuned with simulations.

Based on the chosen value of "N", the resistor value "R" can be calculated. The value "R" is chosen such that the worst case expected variation in the absolute values of the resistor values, as well as variations in $V_{GS(P1)}$ due to process variations, does not de-bias NPN level shift transistor N11'. In a preferred embodiment, the resistor value "R" is such that current flow through first and second bias resistors R1 and R2 is ½ to ⅔ of $I_{BIAS}$. In this way, there will always be a portion of $I_{BIAS}$ available to pull current from the emitter of NPN level shift transistor N11'. That is, if $I_r$ is chosen to be ⅔ of $I_{BIAS}$, and $I_{BIAS}=I_{IN}$:

$$I_r = I_{BIAS} * .66 = I_{IN} * .66 = \frac{V_{GS(P1)}}{N \times R} \tag{32}$$

$$R = \frac{V_{GS(P1)}}{N * .66 * I_{IN}} \tag{33}$$

Figure 10:
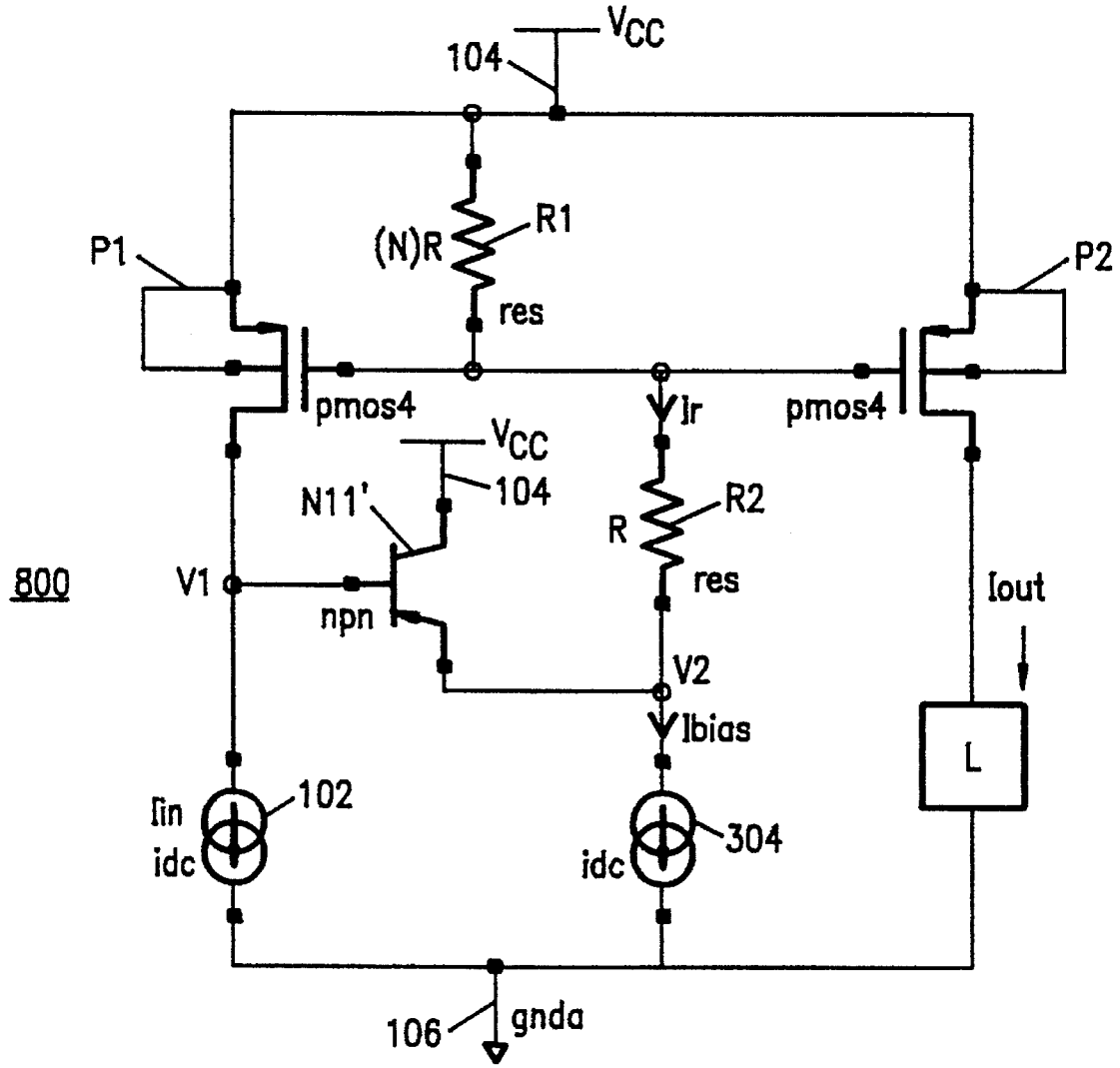
FIG. 10 is a schematic illustration of a PMOS current mirror in accordance with the present invention which utilizes an NPN level shift transistor for level shifting and an independent bias current source for biasing the NPN level shift transistor, and which further utilizes ratioed resistors to keep a first transistor of the PMOS current mirror operating in a saturation region.

FIG. 10 shows a current mirror 1000 in accordance with a further embodiment of the invention. Current mirror 1000 is identical to current mirror 900, except that the built-in" bias source 204' of the current mirror 900 is replaced by an independent bias current source 304. Thus, the constraint of $V2 \geqq V_{DSAT(N12)}$ of equation (7) (i.e. to keep bias current NMOS transistor N12 saturated), is removed.

Similarly, further embodiments in accordance with the present invention employ ratioed resistors with NMOS current mirrors (rather than PMOS current mirrors) to ensure that input voltage headroom, while increased, remains lower than the difference between $V_{CC}$ and $V_{DSAT}$ over worst case process and temperature variations.

Figure 11:
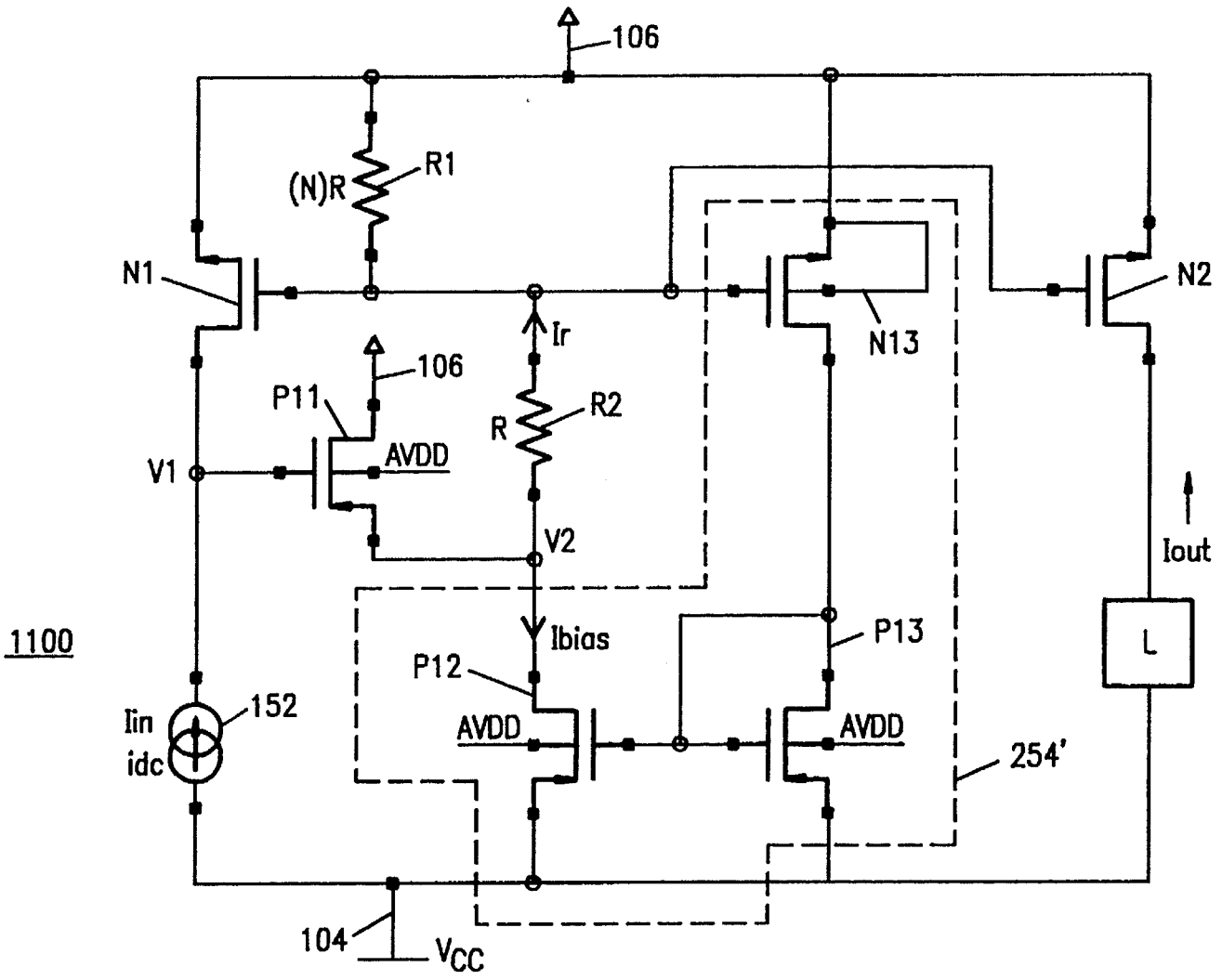
FIG. 11 is a schematic illustration of an NMOS current mirror in accordance with the present invention which utilizes a PMOS level shift transistor for level shifting and a built-in bias current source for biasing the PMOS level shift transistor, and which further utilizes ratioed resistors to keep a first transistor of the NMOS current mirror operating in a saturation region.

FIG. 11 is a schematic diagram of a current mirror 1100 in accordance with such a further embodiment. Current mirror 1100 includes a $V_{CC}$ supply voltage terminal 104 and a negative supply voltage terminal 106. A first NMOS transistor N1 serves as an input device, having its source connected to negative supply voltage terminal 106 and its drain connected to receive input current $I_{IN}$ from a current source 152. A second NMOS transistor N2 serves as an output device, having its source connected to negative supply voltage terminal 106 and its drain connected to a load L.

PMOS transistor P11 is a MOS level shift transistor used to provide an increased voltage to current source 152. PMOS level shift transistor P11 has its drain connected to negative supply terminal 106 and its gate connected to the drain of NMOS transistor N1 and thus to input current source 152. A network of bias current source transistors including bias current source NMOS transistor N13, bias current source PMOS transistor P13, and bias current source PMOS transistor P12 provide a "built-in" bias current source 254' which draws a bias current $I_{BIAS}$ through the drain of bias current source PMOS transistor P12, connected to the source of PMOS level shift transistor P11.

The operation of "built-in" bias current source 254' is now discussed. Bias current source NMOS transistor N13 has its source connected to negative supply voltage terminal 106 and its gate connected to the gate of NMOS transistor N1. Thus, current $I_{IN}$ from current source 152 is mirrored to the drain of bias current source NMOS transistor N13. Bias current source PMOS transistor P13 has its source connected to $V_{CC}$ voltage terminal 104 and its drain connected to its gate. Bias current source PMOS transistor P13 further has its drain connected to the drain of bias current source NMOS transistor N13 to receive the mirrored current. Bias current source PMOS transistor P12 has its gate connected to the gate of bias current source PMOS transistor P13 and its source connected to $V_{CC}$ supply voltage terminal 106. Thus, the mirrored current from the drain of bias current source NMOS transistor N13 is further mirrored through the drain of bias current source PMOS transistor P12.

Similar to current mirror 700, first and second biasing resistors R1 and R2, respectively, ensure that the voltage at the gate of PMOS level shift transistor P11 ("V1") is lower than the difference between GND and $V_{DSAT(N1)}$ over worst case process and temperature variations. First biasing resistor R1 is connected between negative voltage terminal 106 and the gate of first NMOS transistor N1, and second biasing resistor R2 is connected between the gate of first NMOS transistor N1 and the commonly connected source of PMOS level shift transistor P11 and the drain of bias current source PMOS transistor P12.

Second biasing resistor R2 has a resistance value of R and first biasing resistor R1 has a resistance value of N*R, N begin a natural number. The process for choosing the relative values (i.e. "N") of first and second resistors R1 and R2 is now discussed. The voltage across first biasing resistor R1 is $V_{GS(N1)}$. A current $I_r$ is developed across first biasing resistor R1 responsive to $V_{GS(N1)}$; $I_r$ is $V_{GS(N1)}/(N*R)$. Since the gate of NMOS transistors N1 and N2 cannot source or sink current, the current across second biasing resistor R2 is also $I_r$; the voltage across second biasing resistor R2 is $I_r$ * R. Thus, V2 is $$V2 = V_{GND} + \left(\frac{N+1}{N}\right) V_{GS(N1)} \leqq V_{CC} - V_{DSAT(P12)} \tag{34}$$

and the input headroom V1 is $$V1 = V2 - |V_{GS(P11)}| \geqq V_{GND} + V_{DSAT(N1)} \tag{35}$$

As discussed above, $V_{GS(N1)}$ varies with processing and temperature. The maximum value of V2 ("V2max"), assuming the absolute value of $V_{GS(N1)}$ is at its maximum value ("$|V_{GS(N1)}|$slow") is given by:

$$V2max = V_{GND} + \left(\frac{N+1}{N}\right)|V_{GS(N1)}|slow \tag{36}$$

The minimum value of V2 ("V2min"), assuming the absolute value of $V_{GS(N1)}$ is at its minimum value ("$|V_{GS(N1)}|$fast") is given by:

$$V2min = V_{GND} + \left(\frac{N+1}{N}\right)|V_{GS(N1)}|fast \quad (37)$$

$V_{GS(P11)}$ also varies with processing and temperature. The maximum value of V1 ("V1max"), assuming the absolute value of $V_{GS(P11)}$ is at its minimum value ("$|V_{GS(P11)}|$fast") is given by:

$$V1max=(V2max-|V_{GS(P11)}|fast)\geqq V_{GND}+V1max \text{ (desired)} \quad (38)$$

The minimum value of V1 ("V1min"), assuming the absolute value of $V_{GS(P11)}$ is at its maximum ("$|V_{GS(P11)}|$slow") is given by:

$$V1min=(V2min-|V_{GS(P11)}|slow)\geqq V_{DSAT(N1)} \text{ (desired)} \quad (39)$$

Furthermore, $$|V_{GS(P11)}|fast=|V_{T(P11)}|fast+\Delta Vt+V_{DSAT(P11)} \quad (40)$$

and $$|V_{VGS(P11)}|slow=|V_{T(P11)}|slow+\Delta Vt+V_{DSAT(P11)} \quad (41)$$

where $$\Delta Vt=\gamma[\sqrt{2|\phi f|+Vsb}-\sqrt{2|\phi f|}] \quad (42)$$

which accounts for the body effect (i.e. the increased threshold voltage due to the NMOS devices sitting in a P substrate and the PMOS devices sitting in an N well). If twin well processes are used (i.e the P wells are isolated from the N wells), then the body effect term is zero.

Substituting the V2 max/min relationships ((36) and (37)) into the V1 max/min relationship ((38) and (39)) yields an equation for which only the upper bound of N("$N_{upper}$") is unknown:

$$V_{DSAT(N1)}(desired) \leqq V_{GND} + \left(\frac{N_{upper}+1}{N_{upper}}\right)V_{GS(N1)}fast - |V_{GS(P11)}|slow \quad (43)$$

and an equation for which only the lower bound of N("$N_{lower}$") is unknown:

$$V1max = V_{GND} + \left(\frac{N_{lower}+1}{N_{lower}}\right)V_{GS(N1)}slow - |V_{GS(P11)}|fast \geqq V1max(desired) \quad (44)$$

From (43), $N_{upper}$ can be calculated. That is, $N_{upper}$ is $$N_{upper}=\frac{|V_{T(N1)}|fast+V_{DSAT(N1)}}{V_{DSAT(N1)}-V_{GND}-V_{GS(N1)}fast+|V_{GS(P11)}|slow} \quad (45)$$

From (44), $N_{lower}$ can be calculated.

$$N_{lower}=\frac{|V_{T(N1)}|slow+V_{DSAT(N1)}}{V1max-V_{GND}-V_{GS(N1)}slow+|V_{GS(P11)}|fast} \quad (46)$$

In practice, a value for N between $N_{upper}$ and $N_{lower}$ would be chosen, and the chosen value for "$N_{chosen}$" would be fine tuned with simulations.

Furthermore, PMOS level shift transistor P11 may be sized to so as to make $V_{DSAT(P11)}$ negligible to provide further assurance that PMOS level shift transistor P11 remains saturated.

Based on the $N_{chosen}$, the resistor value "R" can be calculated. "R" is a value such that the worst case expected variation in the absolute values of the resistor values, as well as variations in $V_{GS(N1)}$ due to process variations, does not de-bias PMOS level shift transistor P11. In a preferred embodiment, the resistor value "R" is such that current flow through first and second bias resistors R1 and R2 is ½ to ⅔ of $I_{BIAS}$. In this way, there will always be a portion of $I_{BIAS}$ available to pull current from the drain of PMOS level shift transistor P11. That is, if $I_r$ is chosen to be ⅔ of $I_{BIAS}$.

$$I_r = I_{BIAS} * .66 = I_{IN} * .66 = \frac{V_{GS(P1)}}{N_{chosen} * R} \quad (47)$$

$$R = \frac{V_{GS(P1)}}{N_{chosen} * .66 * I_{IN}} \quad (48)$$

Figure 12:
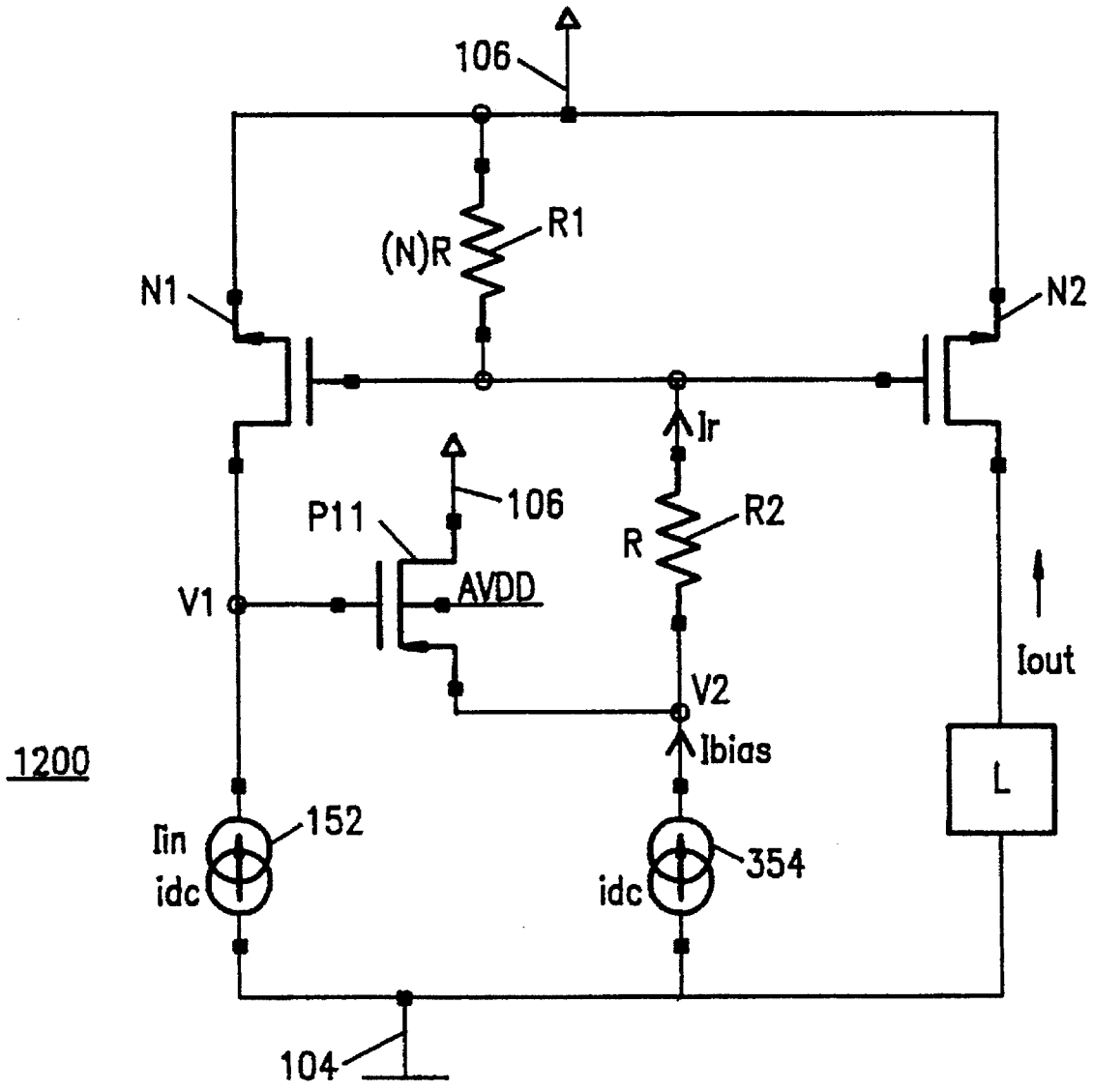
FIG. 12 is a schematic illustration of an NMOS current mirror in accordance with the present invention which utilizes a PMOS level shift transistor for level shifting and an independent bias current source for biasing the PMOS level shift transistor, and which further utilizes ratioed resistors to keep a first transistor of the NMOS current mirror operating in a saturation region.

FIG. 12 is a schematic diagram of a current mirror 1200 in accordance with a further embodiment of the invention. Current mirror 1200 is identical to current mirror 1100, except that the "built-in" bias source 254' of current mirror 1100 is replaced by an independent bias current source 354. Thus, the operation of current mirror 1200 is similar to the operation of the current mirror 1100, except that the constraint of $V2 \geqq V_{DSAT(P12)}$ of equation (34) (to keep bias current PMOS transistor P12 saturated), is removed.

Figure 13:
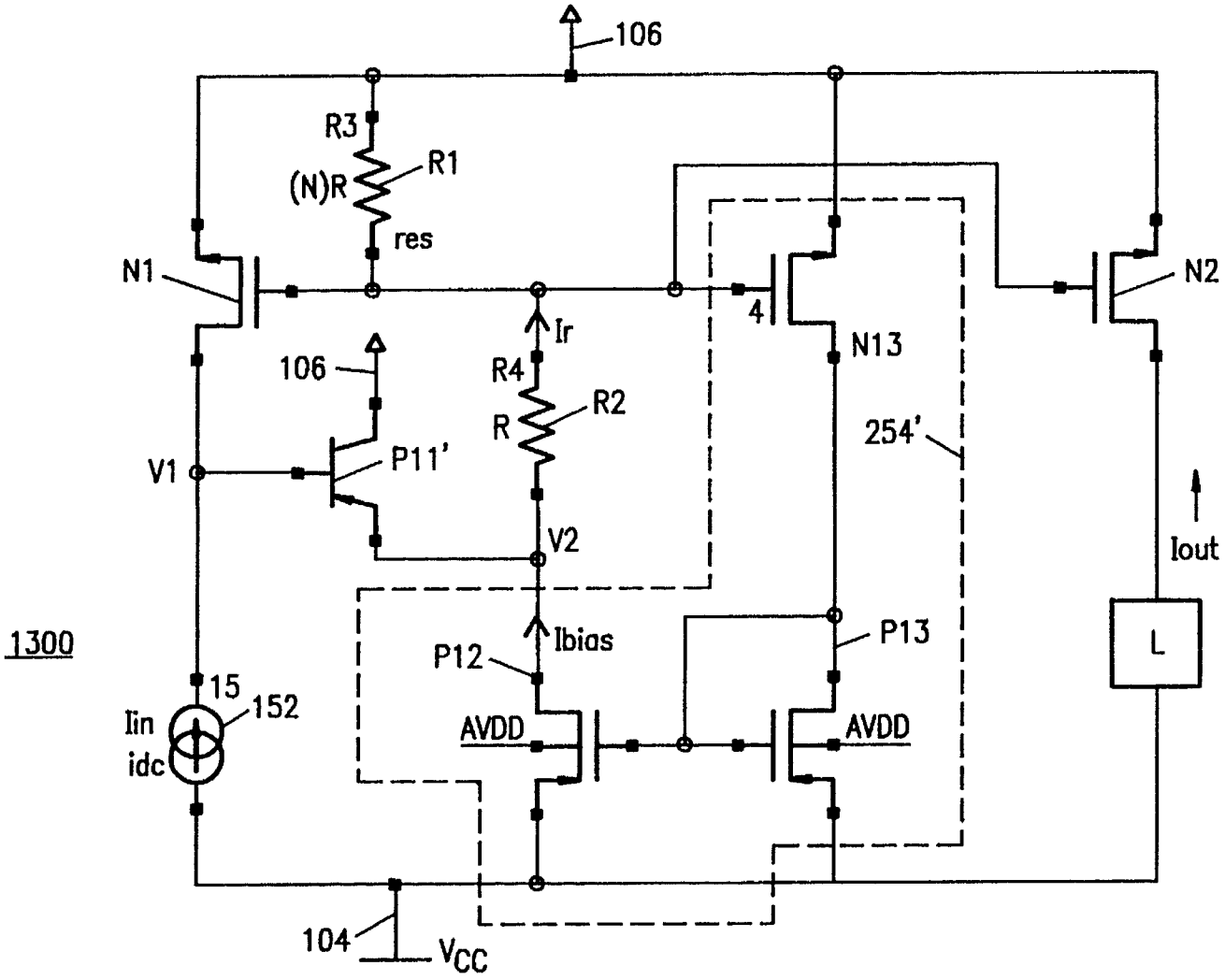
FIG. 13 is a schematic illustration of an NMOS current mirror in accordance with the present invention which utilizes a PNP level shift transistor for level shifting and a built-in bias current source for biasing the PNP level shift transistor, and which further utilizes ratioed resistors to keep a first transistor of the NMOS current mirror operating in a saturation region.

FIG. 13 is a schematic diagram of a current mirror 1300 in accordance with a still further embodiment of the invention. Current mirror 1300 is similar to current mirror 1100, except that PMOS level shift transistor P11 is replaced by PNP level shift transistor P11'. That is, PNP level shift transistor P11' has its collector connected to negative voltage supply terminal 106 and its base connected to the drain of NMOS transistor N1 and thus to input current source 152. The network of bias current source transistors provide a "built-in" bias current source 254' which draws a portion of a bias current $I_{BIAS}$, from the drain of bias current source PMOS transistor P12, connected to the emitter of PNP level shift transistor P11'.

In current mirror 1300, first and second biasing resistors R1 and R2, respectively, ensure that the voltage at the emitter of PNP level shift transistor P11' ("V1") is greater than the difference between $V_{GND}$ and $V_{DSAT(N1)}$ over worst case process and temperature variations. First biasing resistor R1 is connected between the $V_{CC}$ terminal 104 and the gate of first NMOS transistor N1, and second biasing resistor R2 is connected between the gate of first PMOS transistor P1 and bias current source PMOS transistor P12.

Second biasing resistor R2 has a resistance value of R and first biasing resistor R1 has a resistance value of N*R, N being a natural number. The process for choosing the relative values (i.e. "N") of first and second resistor R1 and R2 is similar to the process for choosing the relative values of first and second resistors R1 and R2 for current mirrors 1100 and 1200, where $V_{be(P1')}$ is substituted for $|V_{GS(P11')}|$. The voltage across first biasing resistor R1 is $V_{GS(N1)}$. The current $I_r$ across first biasing resistor R1 is thus $V_{GS(N1)}/(N*R)$. Since the current across second biasing resistor R2 is also $I_r$, the voltage across second biasing resistor R2 is $I_r * R$. Thus, V2 is $$V2 = V_{GND} + \left(\frac{N+1}{N}\right)V_{GS(N1)} \leqq V_{CC} - V_{DSAT(P12)}$$

and the input voltage headroom is $$V1=V2-V_{be(P11')}\geqq V_{GND}+V_{DSAT(N1)} \quad (50)$$

As discussed above, $V_{GS(N1)}$ varies with processing and temperature. The maximum value of V2 ("V2max"), assuming the absolute value of $V_{GS(N1)}$ is at its maximum value ("$|V_{GS(N1)}|slow$") is given by:

$$V2max = V_{GND} + \left(\frac{N+1}{N}\right)|V_{GS(N1)}|slow \quad (51)$$

The minimum value of V2 ("V2min"), assuming the absolute value of $V_{GS(N1)}$ is at its minimum value ("$|V_{GS(N1)}|slow$") is given by:

$$V2min = V_{GND} + \left(\frac{N+1}{N}\right)|V_{GS(N1)}|fast \quad (52)$$

$V_{be(P11')}$ also varies with processing and temperature. The maximum value of V1 ("V1max"), assuming the absolute value of $V_{be(P11')}$ is at its maximum value ("$|V_{be(P11')}|high$") is given by:

$$V1max = V2max - |V_{be(P11')}|low \leqq V1max \text{ (desired)} \quad (53)$$

The minimum value of V1 ("V1min"), assuming the absolute value of $V_{be(P11')}$ is at its minimum ("$|V_{be(P11')}|low$") is given by:

$$V1min = V2min - |V_{be(P11')}|high \geqq V_{GND} + V_{DSAT(N1)} \text{ desired} \quad (54)$$

Substituting the V2 max/min relationship ((51) and (52)) into the V1 max/min relationship ((53) and (54)) yields an equation for which only the upper board of N ("$N_{upper}$") is unknown:

$$V_{DSAT(N1)}(\text{desired}) \leqq \left(\frac{N_{upper}+1}{N_{upper}}\right)|V_{T(N1)}|fast + V_{DSAT(N1)} - |V_{be(P11')}|high \quad (55)$$

and an equation for which only the lower bound of N ("$N_{lower}$") is unknown:

$$V1max(\text{desired}) \geqq \left(\frac{N_{lower}+1}{N_{lower}}\right)(|V_{GS(N1)}|slow - |V_{be(P11')}|low \quad (56)$$

From (55), $N_{upper}$ can be calculated. That is, $N_{upper}$ is:

$$N_{upper} = \frac{|V_{T(N1)}|fast + V_{DSAT(N1)}}{|V_{be(P11')}|high - |V_{T(N1)}|fast} \quad (57)$$

From (56), $N_{lower}$ can be calculated. $N_{lower}$ is:

$$N_{lower} = \frac{|V_{GS(N1)}|slow}{V1max(\text{desired}) - |V_{GS(N1)}|slow + |V_{be(P11')}|low} \quad (58)$$

In practice, a value for N between $N_{upper}$ and $N_{lower}$ would be chosen, and the chosen value for N ("$N_{chosen}$") would be fine-tuned with simulations.

Based on the chosen value of "N", the resistance value "R" can be calculated. The value "R" is chosen such that the worst case expected variation in the absolute values of the resistor values, as well as variations in $V_{GS(N1)}$ due to process variations, does not de-bias PNP level shift transistor P11'. In a preferred embodiment, the resistor value "R" is such that current flow through first and second bias resistors R1 and R2 is ½ to ⅔ of $I_{BIAS}$. In this way, there will always be a portion of $I_{BIAS}$ available to pull current from the emitter of NPN level shift transistor N11'. That is, if $I_r$ is chosen to be ⅔ of $I_{BIAS}$, and $I_{BIAS}=I_{IN}$:

$$Ir = I_{BIAS} * .66 = I_{IN} * .66 = \frac{V_{GS(P1)}}{N \times R} \quad (59)$$

$$R = \frac{V_{GS(P1)}}{N * .66 * I_{IN}} \quad (60)$$

Figure 14:
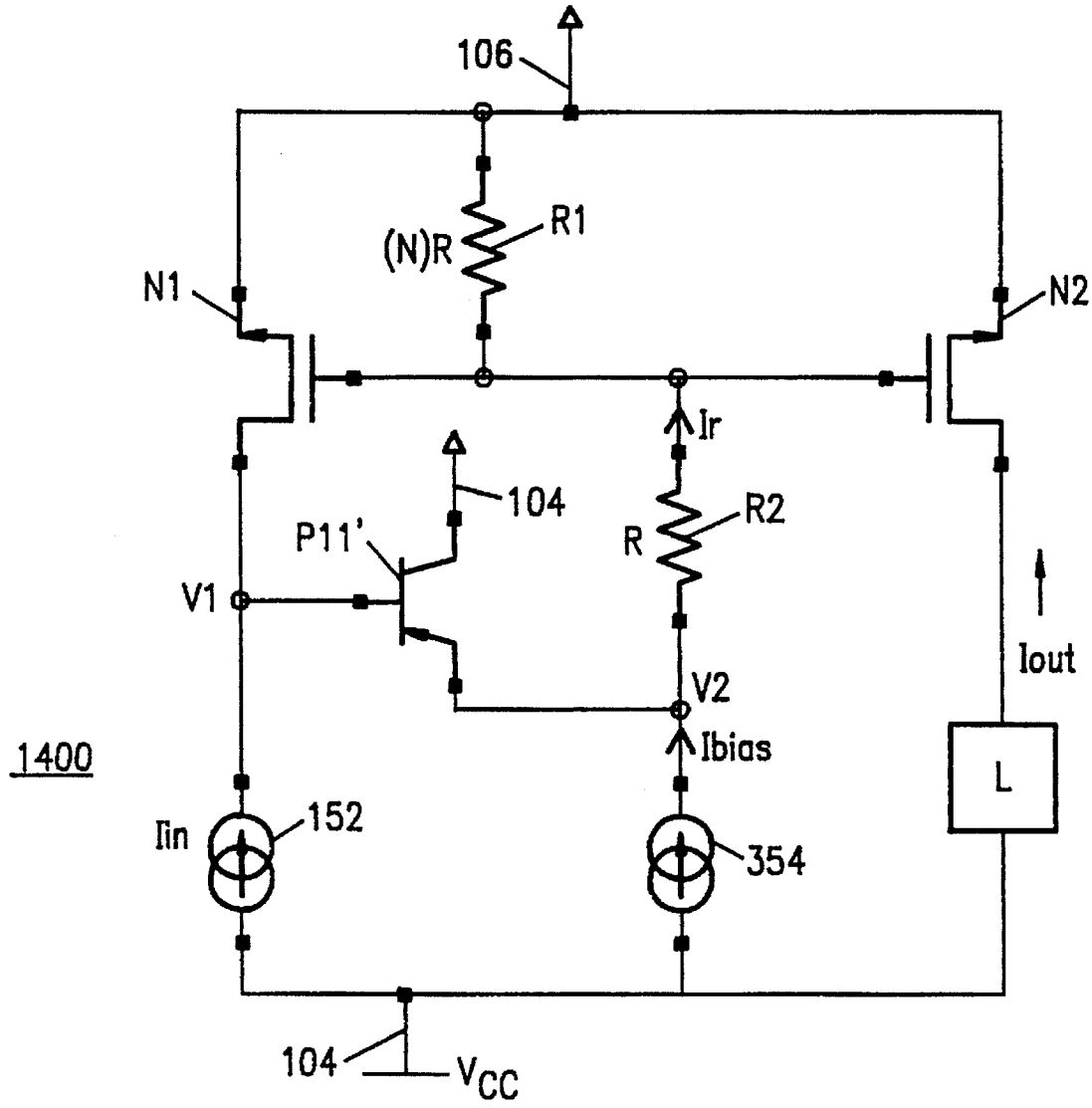
FIG. 14 is a schematic illustration of an NMOS current mirror in accordance with the present invention which utilizes an PNP level shift transistor for level shifting and a built-in bias current source for biasing the PNP level shift transistor, and which further utilizes ratioed resistors to keep a first transistor of the NMOS current mirror operating in a saturation region.

FIG. 14 shows a current mirror 1400 in accordance with a further embodiment of the invention. Current mirror 1400 is identical to current mirror 1300, except that the built-in" bias source 254' of current mirror 1300 is replaced by an independent bias current source 354. Thus, the constraint of $V2 \geqq V_{DSAT(P12)}$ of equation (49) (i.e. to keep bias current PMOS transistor P12 saturated), is removed.

Thus, a current mirror which provides improved input voltage headroom has been described.

Figure 15:
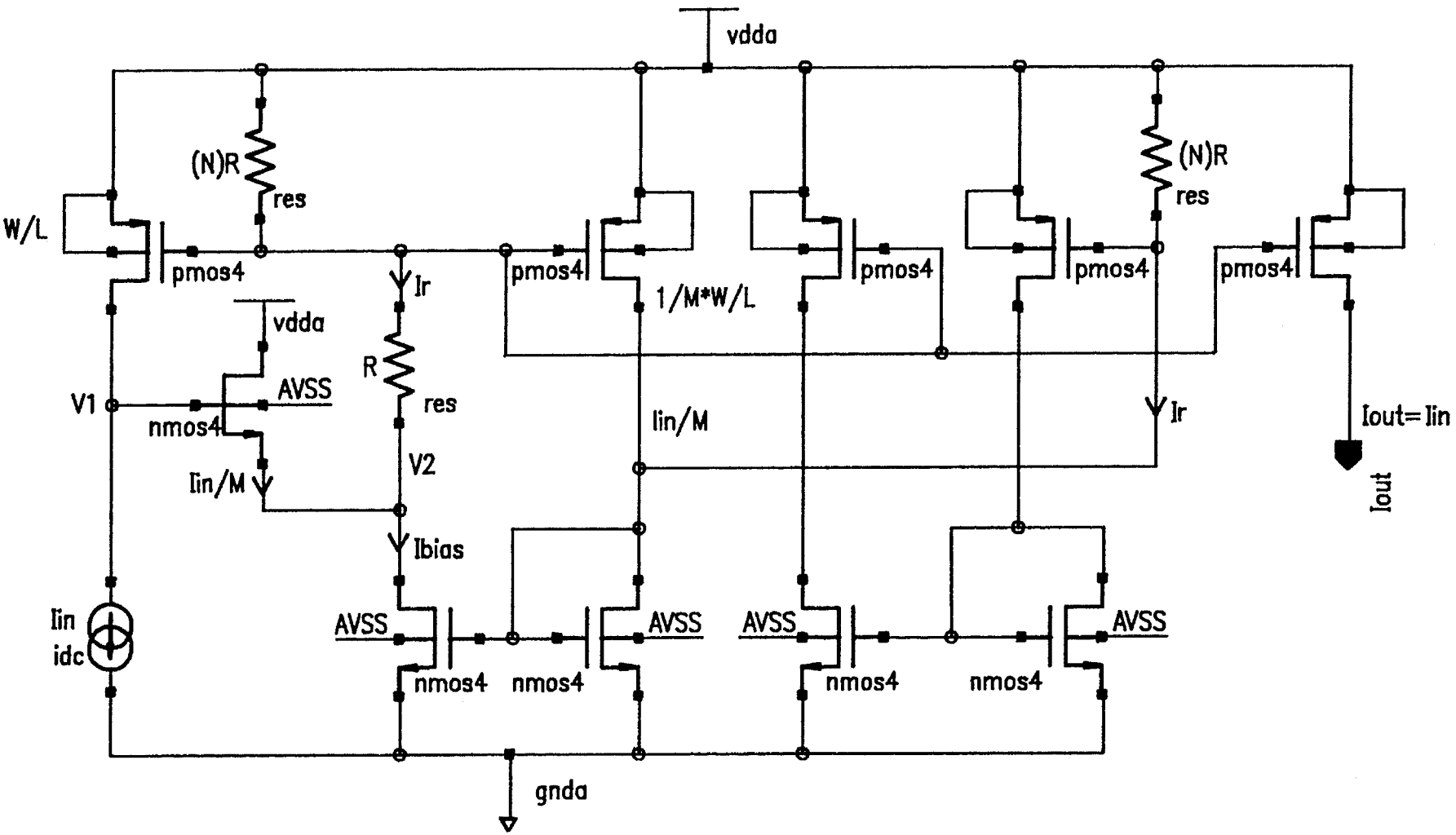
FIG. 15 is a schematic illustration of an enhanced PMOS current mirror in accordance with the present invention that utilizes an NMOS level shifter transistor and ratioed resistors.
Figure 16:
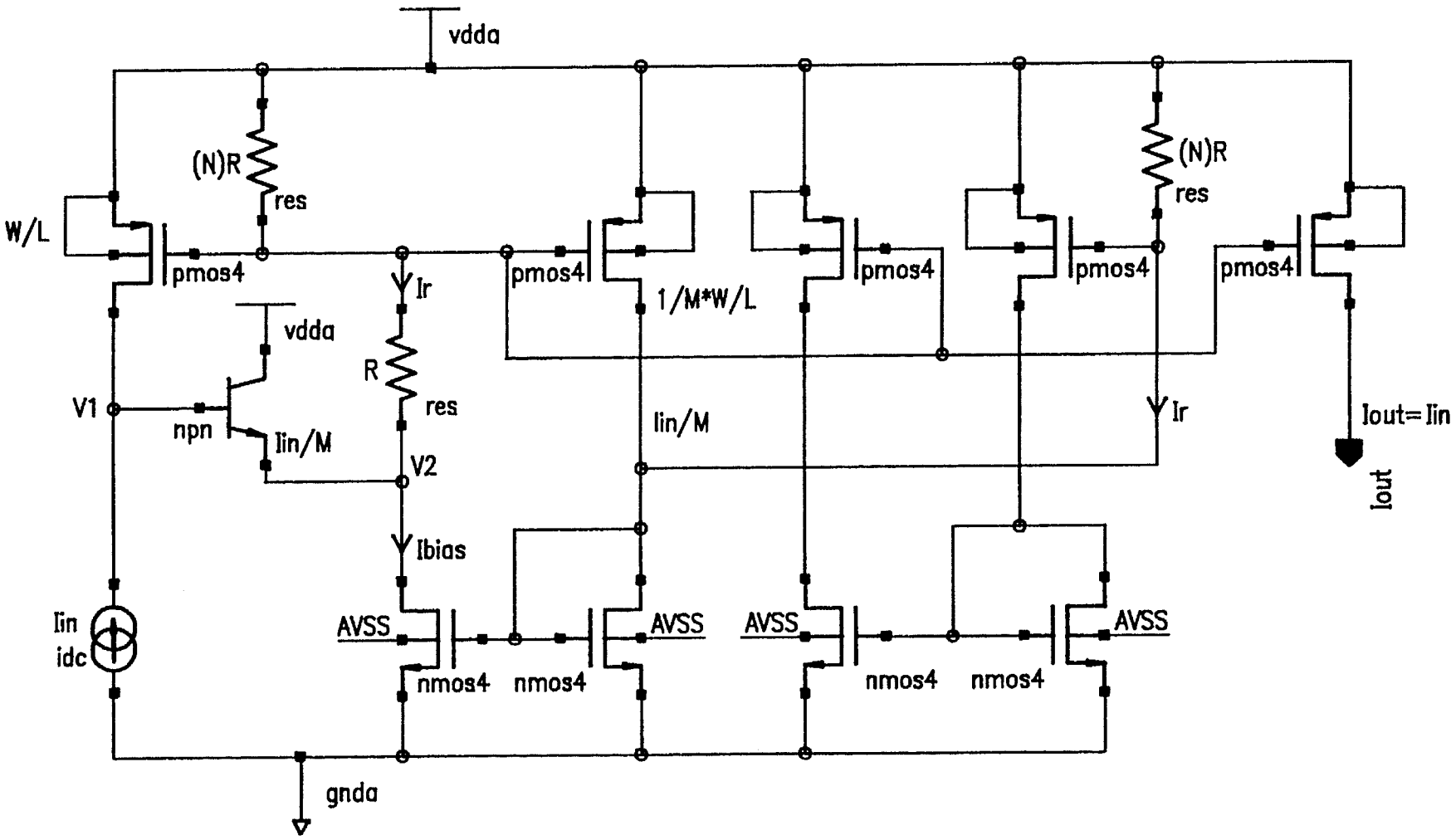
FIG. 16 is a schematic illustration of an enhanced BiCMOS current mirror in accordance with the present invention that utilizes a NPN level shifter transistor and ratioed resistors.

FIG. 15 shows an embodiment of an enhanced PMOS current mirror that utilizes an NMOS level shifter transistor and ratioed resistors. FIG. 16 shows an embodiment of an enhanced Bi-CMOS current mirror that utilizes an NPN level shifter transistor and ratioed resistors.

The circuits described above address the problem of reliable operation of a current mirror over temperature and process while maintaining an improved headroom voltage. The circuit shown in FIG. 17, and discussed below, addresses variations in the headroom voltage. The principle of operation is similar. However, the FIG. 17 circuit includes additional circuitry with a feedback amplifier to desensitize variations in headroom voltage due to process and temperature variability.

As stated above, although the FIGS. 3–16 circuits improve reliability in the operation of a current mirror, these circuits do not address the variability in the headroom voltage due to process and temperature variations. The intent of the circuit configuration incorporating a Vgs shift at the Iin node is to improve the voltage headroom. Thus, while these circuits resolve the problem of reliable operation, it is at the expense of somewhat reduced voltage headroom. However, if one can't sacrifice voltage headroom for improved reliability, then improvements must be employed at the expense of additional circuitry.

Figure 17:
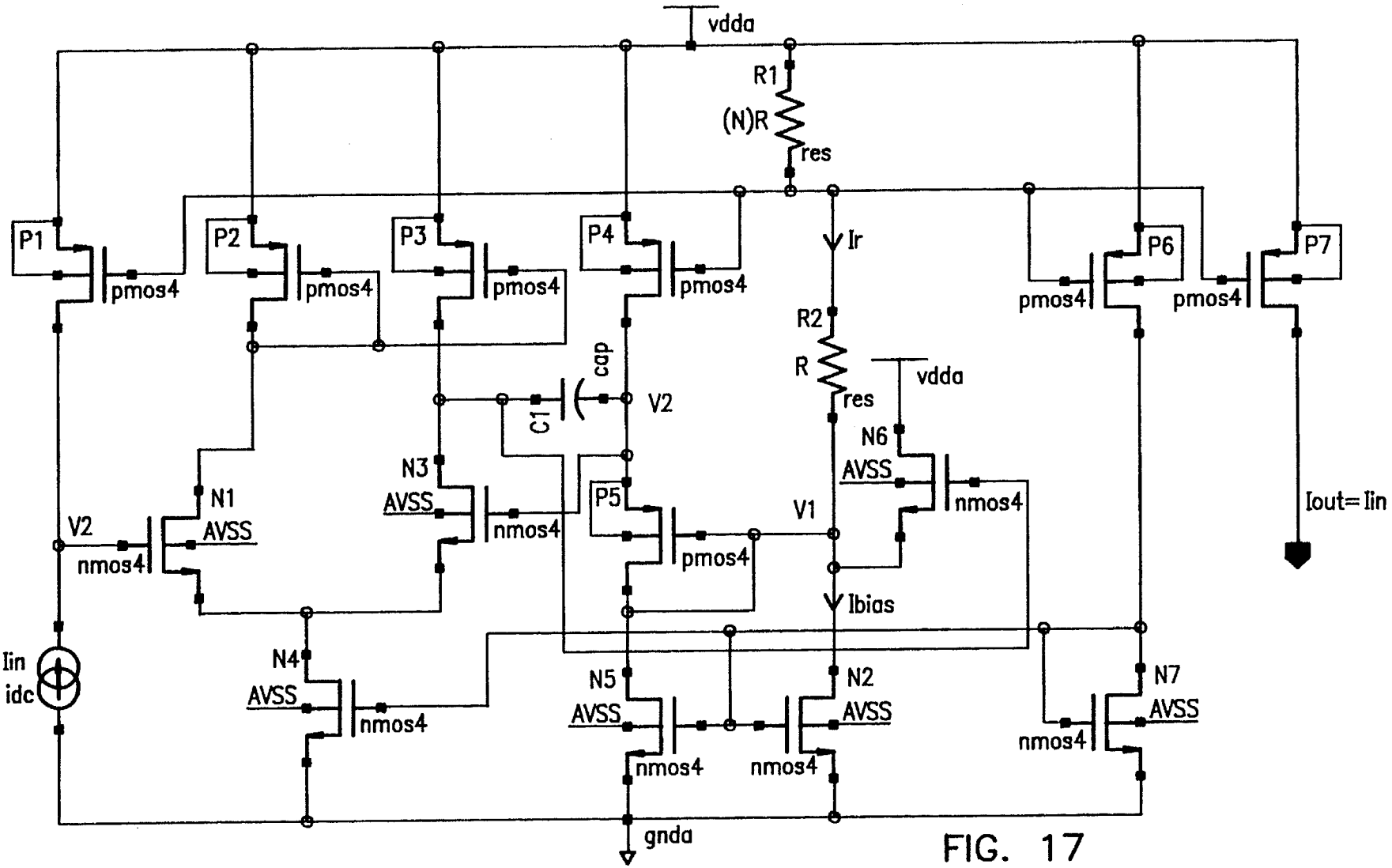
FIG. 17 is a schematic illustration of a PMOS current mirror in accordance with the present invention that utilizes an NMOS level shifter transistor and ratioed resistors and, in addition, utilizes an amplifier network to desensitize varations in the headroom voltage.

The FIG. 17 embodiment of the invention, like the FIGS. 7–16 circuits described above, uses ratioed resistors to ensure that voltage V2 is lower than the difference of $V_{CC}$ and Vdsat over worst case process and temperature. However, the ratioed resistors now are also used to divide the Vgsp1 variation by a factor of N. The new circuit topology tries to cancel Vtn1 variations by employing identical NMOS devices having their sources coupled and forming an amplifier feedback loop. The amplifier is compensated by capacitor C1. The amplifier's closed loop behavior forces both gates to have equal voltages. The right NMOS device's gate, with an equally identical PMOS device to P1 and biased at same current density, has a desired voltage for V2 which is shifted up by PMOS device P5 from V1. The feedback loop forces the gate of the left NMOS device to follow the right gate. Thus, the headroom voltage V2 can be made to vary only by a 1/N factor. Since Vgsp is nominally about 1.25 v, assuming device P1 is sized such that Vdsatp1=0.3 v, with plus/minus variation of 150 mv, then it implies that V2 can be made 0.625 v below VCC with plus/minus 75 mv variation for N=2. One can write the following equations relating V1, and V2 in terms of Vgsp, and Vdsatp1 (similar to the above-provided equations):

$$V1 = V_{CC} - \left(\frac{N+1}{N}\right)V_{gsp1} \geqq V_{dsatn2} \quad (61)$$

$$V2 = V1 + V_{gsp5} \leqq V_{CC} - V_{dsatp1} \quad (62)$$

Where Vgsp is as follows:

$$V_{gsp} = |V_{tp}| + V_{dsatp} \quad (63)$$

Substituting equation 61 in equation 62, and assuming Vgsp1=Vgsp5, one obtains:

$$V_{dsatp1} \leqq \left( \frac{V_{GS(P1)}}{N} \right)$$

The above expression can be further simplified by substituting equation 63 as follows:

$$N \leqq 1 + \left( \frac{|V_{tp1}|}{V_{dsatp1}} \right)$$

With Vtp1min, one can obtain an upper bound on N. A lower bound on N can be obtained from, equation 61 considering following condition:

$$V1\min(\text{desired}) \leqq V1\min$$

Where V1min is as follows:

$$V1\min = V_{CC} - \left( \frac{N+1}{N} \right) (|V_{tp1}|\text{slow} + V_{dsatp1})$$

All quantities in the above expression are known, so one can solve for N and obtain a lower bound on N.

Now the resistors values have to be calculated. The formulation is same as discussed above. The resistor sizes are selected such that the worst case variation in absolute values of the resistors as well as the process variations in Vgsp1 do not de-bias device N6. In other words, a bias current source is used which sinks about 1.5x to 2x of the current expected to flow through the resistor leg. This ensures that the bias current source will always be pulling current from device N6 which resistors can't supply. This device is also part of the feedback loop; therefore, it is necessary to ensure active operation of this device. The bias current is derived from the mirror itself as in the circuit discussed above. However, if one has access to a bias current source, an independent current source for this biasing could be used as well.

The matching of the resistors is important to minimize variations in N. One possible formulation is as follows.

$$Ir = \frac{V_{GS(P1)}}{N \times R} \tag{64}$$

$$(1.5 \times Ir) = I_{bias} = I_{IN} \tag{65}$$

Also note that complimentary implementations where NMOS and PMOS devices are substituted for each other are also possible with corresponding formulations and proper substitutions in the above equations.

It should be understood that various alternatives to the embodiments of the invention described herein may be employed in practicing the invention. As but one example, bipolar transistor may be substituted for the MOS current mirror input and output transistors shown in the exemplary embodiments of FIGS. 7–17. It is intended that the following claims define the scope of the invention and that methods and apparatus within the scope of these claims and their equivalents be covered thereby.

What is claimed is:

1. A current mirror comprising:

a first power supply terminal for receiving a first supply voltage;

a second power supply terminal for receiving a second supply voltage;

a first mirror transistor having a first current handling terminal coupled to a first one of said power supply terminals a second current handling terminal serving as an input terminal for receiving an input current to be mirrored, and a control terminal;

a second mirror transistor having a first current handling terminal coupled to said first power supply terminal, a second current handling terminal serving as an output terminal for providing a mirrored output current to a load as a function of said input current to be mirrored, and a control terminal coupled to said control terminal of said first mirror transistor;

a level shift device comprising a level shift transistor having a first current handling terminal coupled to said first power supply terminal, a second current handling terminal, and a control terminal coupled to said input terminal;

a first biasing resistance element coupled between said first power supply terminal and said first mirror transistor control terminal; and a second biasing resistance element coupling said commonly coupled control terminals of said first and second mirror transistors to said second current handling terminal of said level shift device.

2. A current mirror as in claim 1, further comprising:

a bias current source coupled to cause current through said level shift transistor.

3. A current mirror as in claim 2, wherein said bias current source is coupled between said second current handling terminal of said level shift transistor and said second power supply terminal.

4. A current mirror as in claim 1, wherein said first and second mirror transistors comprise MOS transistors.

5. A current mirror as in claim 4, wherein said level shift transistor comprises a bipolar transistor.

6. A current mirror as in claim 5, wherein said first and second current mirror transistors comprise N channel MOS transistors and said level shift transistor comprises a PNP bipolar transistors.

7. A current mirror as in claim 5, wherein said first and second mirror transistors comprise P channel MOS transistor and said level shift transistor comprises an NPN bipolar transistor.

8. A current mirror as in claim 6, wherein said first voltage supply is positive and said second voltage supply is ground.

9. A current mirror as in claim 7, wherein said first voltage supply is positive and said second voltage supply is ground.

10. A current mirror as in claim 4, wherein said level shift transistor comprises a MOS transistor.

11. A current mirror as in claim 10, wherein said first and second mirror transistors comprises P channel MOS transistors and said level shift transistor comprises an N channel MOS transistor.

12. A current mirror as in claim 11, wherein said first supply voltage is a positive voltage and said second supply voltage is ground.

13. A current mirror as in claim 12, wherein said first and second mirror transistors comprises N channel MOS transistors and said level shift transistor comprises a P channel MOS transistor.

14. A current mirror as in claim 13, wherein said first supply voltage is ground and said second supply voltage is a negative voltage.

15. A current mirror as in claim 1, further comprising:

a "built-in" bias current source having a first bias current source transistor having a first current handling terminal coupled to said first power supply terminal, a second current handling terminal serving as an output terminal for providing a first mirrored bias current as a function of said input current to be mirrored, and a control terminal coupled to said control terminal of said first mirror transistor;

a second bias current source transistor having a first current handling terminal for receiving said first mirrored bias current, a second current handling terminal coupled to said second power supply terminal, and a control terminal coupled to said first current handling terminal of said second bias current source transistor, and a third bias current source transistor having a first current handling terminal coupled to said second power supply terminal, a control terminal coupled to said control terminal of said second bias current source transistor, and a second current handling terminal coupled to said second current handling terminal of said level shift transistor for providing a bias current to said level shift transistor as a function of said first mirrored bias current.

16. A current mirror comprising:

a first power supply terminal for receiving a first supply voltage;

a second power supply terminal for receiving a second supply voltage;

a first mirror transistor having a first current handling terminal coupled to a first one of said power supply terminals, a second current handling terminal serving as an input terminal for receiving an input current to be mirrored, and a control terminal;

a second mirror transistor having a first current handling terminal coupled to said first power supply terminal, a second current handling terminal serving as an output terminal for providing a mirrored output current to a load as a function of said input current to be mirrored, and a control terminal coupled to said control terminal of said first mirror transistor;

a level shift device comprising a level shift transistor having a first current handling terminal coupled to said first power supply terminal, a second current handling terminal coupled to said second power supply terminal, and a control terminal coupled to said second current handling terminal, whereby the level shift device operates in a saturation mode;

a first biasing resistance element coupled between said first power supply terminal and said first mirror transistor control terminal;

a second biasing resistance element coupling said commonly coupled control terminals of said first and second mirror transistors to said second current handling terminal of said level shift device; and a feedback amplifier coupling the first current handling terminal of the level shift device to the input terminal with negative feedback.

17. A current mirror as in claim 16 further comprising:

a first bias current source coupling said first current handling terminal of the level shift device to said first power supply terminal; and a second bias current source coupling said second current handling terminal of said level shift device to said second power supply terminal.

18. A current mirror as in claim 16 wherein said first and second mirror transistors comprise MOS transistors.

19. A current mirror as in claim 18, wherein said level shift transistor comprises a bipolar transistor.

20. A current mirror as in claim 19, wherein said first and second current mirror transistors comprise N channel MOS transistors and said level shift transistor comprises an NPN bipolar transistor.

21. A current mirror as in claim 19, wherein said first and second mirror transistors comprise P channel MOS transistors and said level shift transistor comprises a PNP bipolar transistor.

22. A current mirror as in claim 20, wherein said first voltage supply is positive and said second voltage supply is ground.

23. A current mirror as in claim 21, wherein said first voltage supply is positive and said second voltage supply is ground.

24. A current mirror as in claim 18, wherein said level shift transistor comprises a MOS transistor.

25. A current mirror as in claim 24, wherein said first and second mirror transistors comprises P channel MOS transistors and said level shift transistor comprises a P channel MOS transistor.

26. A current mirror as in claim 25, wherein said first supply voltage is a positive voltage and said second supply voltage is ground.

27. A current mirror as in claim 26, wherein said first and second mirror transistors comprises N channel MOS transistors and said level shift transistor comprises an N channel MOS transistor.

28. A current mirror as in claim 27, wherein said first supply voltage is ground and said second supply voltage is a negative voltage.

29. A current mirror as in claim 16, further comprising:

a "built-in" bias current source having a first bias current source transistor having a first current handling terminal coupled to said first power supply terminal, a second current handling terminal serving as an output terminal for providing a first mirrored bias current as a function of said input current to be mirrored, and a control terminal coupled to said control terminal of said first mirror transistor;

a second bias current source transistor having a first current handling terminal for receiving said first mirrored bias current, a second current handling terminal coupled to said second power supply terminal, and a control terminal coupled to said first current handling terminal of said second bias current source transistor, and a third bias current source transistor having a first current handling terminal coupled to said second power supply terminal, a second current handling terminal coupled to said second current handling terminal of said second current handling terminal of said level shift transistor for providing a bias current to said level shift transistor as a function of said first mirrored bias current.

* * * * *